US006719596B2

(12) United States Patent
Funayose et al.

(10) Patent No.: US 6,719,596 B2
(45) Date of Patent: Apr. 13, 2004

(54) POWER SOURCE SYSTEM FOR A BOAT

(75) Inventors: Yusuke Funayose, Saitama (JP); Toru Hasegawa, Saitama (JP); Tomohiko Yashiro, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/238,583

(22) Filed: Sep. 11, 2002

(65) Prior Publication Data

US 2003/0064641 A1 Apr. 3, 2003

(30) Foreign Application Priority Data

Sep. 18, 2001 (JP) ..... 2001-283741
Apr. 2, 2002 (JP) ..... 2002-100508

(51) Int. Cl.[7] ..... B63H 21/22
(52) U.S. Cl. ..... 440/1; 440/84
(58) Field of Search ..... 440/1, 2, 84; 180/272; 340/984; 701/21

(56) References Cited

U.S. PATENT DOCUMENTS 4,917,061 A * 4/1990 Nagakura ..... 123/179.3
5,873,322 A * 2/1999 Koyanagi ..... 114/230.12
6,024,068 A * 2/2000 Nakase et al. ..... 123/198 D
6,352,045 B1 * 3/2002 Takashima ..... 114/55.5
6,557,509 B1 * 5/2003 Hall et al. ..... 123/179.16

FOREIGN PATENT DOCUMENTS

JP 9-169298 6/1997

* cited by examiner

*Primary Examiner*—S. Joseph Morano
*Assistant Examiner*—Andrew Wright
(74) *Attorney, Agent, or Firm*—Birch, Stewart, Kolasch & Birch, LLP

(57) ABSTRACT

A power source system for a small boat is equipped with a main switch with a lanyard switch capable of turning OFF power source in case of an emergency by connecting to an occupant by wire. The power system controls the power source to accessories, including a fuel injection system. The power source system includes a main relay for turning ON/OFF power source to be supplied to the accessories, and a control unit (display control unit) connected in parallel to the main switch in order to control the main relay. An ON/OFF state of the main switch is monitored by the control unit (display control unit) to control the ON/OFF state of the main relay on the basis of the ON/OFF state of the main switch. With this system, it is possible to collectively control the ON/OFF of the power source supplied to the accessories, including the fuel injection system. Thus, the power source system can be simplified.

20 Claims, 18 Drawing Sheets

POWER SOURCE SYSTEM FOR A BOAT

CROSS-REFERENCE TO RELATED APPLICATIONS

The present application claims priority under 35 U.S.C. §119 to Japanese Patent Application Nos. 2001-283741, filed Sep. 18, 2001, and 2002-100508, filed Apr. 2, 2002, the entire contents of which are hereby incorporated by reference.

BACKGROUND OF THE INVENTION

1. Field of the Invention

The present invention relates to a power source system for a small boat equipped with a lanyard switch capable of turning OFF a power source in case of an emergency by connecting to an occupant by a wire of the lanyard. The power source system supplies power to and controls a fuel injection system and other accessories of the boat.

2. Description of Background Art

One example of a power source system for a small boat is described in Japanese Published Unexamined Application No. 9-169298, "Starting System for Small Ship".

According, to FIGS. 2 and 3 of the official gazette describing this system, a gauge panel 6 is provided with control means E, the gauge panel 6 is provided with a meter 61 such as a speedometer and a tachometer. Also provided are a stop watch and a display unit 620 for displaying navigation time. A power source is connected to a gauge panel 6 through all ON/OFF switch 66 and a starter motor 68 is connected through a relay 67. By inputting a secret number, the starter motor 68 is caused to rotate. Operating means 62 for starting an engine 5 is provided for the gauge panel 6; and a mode change-over button 610 for switching the display unit 620 is provided on the gauge panel 6.

A starting system for the above-described small ship is a power source system only for rotating a starting motor 67 by a gauge panel 6 equipped with control means E for starting the engine 5.

However, the small ship has a plurality of accessories, such as a main switch with a lanyard switch and the fuel injection system. Thus, this conventional system could be improved by having a control unit (display control unit) as the gauge panel 6 capable of collectively controlling the main switch with a lanyard switch and the power source to be supplied to the accessories.

SUMMARY AND OBJECTS OF THE INVENTION

Therefore, it is an object of the present invention to provide a power source system for a small boat capable of collectively controlling the state of the main switch with the lanyard switch and the power source to be supplied to the accessories by the control unit (display control unit).

In order to achieve the above-described object, in a first aspect of the present invention, a power source system is provided for a small boat equipped with a main switch with a lanyard switch capable of turning OFF power source in case of an emergency by connecting to an occupant by wire. The power source supplies power to a control unit (ECU) for control accessories and an engine of the boat. The power source system is equipped with a main relay for turning ON/OFF power source to be supplied to the accessories and a control unit (display control unit) connected in parallel to the main switch in order to control the main relay. An ON/OFF state of the main switch is monitored by the control unit (display control unit) to control the ON/OFF state of the main relay on the basis of the ON/OFF state of the main switch.

In order to turn ON/OFF power source to be supplied to a control unit (ECU) and the like for controlling the accessories and the engine, a main relay is provided. In order to control this main relay, a control unit (display control unit) is connected in parallel to the main switch. An ON/OFF state of the main switch is monitored by the control unit (display control unit), and the main relay is turned ON/OFF on the basis of the ON/OFF state, whereby ON/OFF of the power source to be supplied to the control unit (ECU) for controlling the accessories and the engine is collectively controlled. As a result, the power source system can be simplified.

According to a second aspect of the present invention, when the main switch shifts from an ON-state to an OFF-state, the main relay is instantaneously switched from ON to OFF, and the control unit (display control unit) maintains the ON-state in the OFF-state of the main switch during a predetermined time period.

For example, when starting up the power source, the control unit (display control unit) often subjects the display device and the accessories to fault diagnosis and the like. Therefore, when the power source for the control unit (display control unit) is carelessly dropped, it takes time to start Up the control unit (display control unit).

Thus, in the OFF-state of the main switch during a predetermined time period, the control unit (display control unit) maintains the ON-state, whereby the main switch is switched to the OFF-state, the main relay is instantaneously switched to OFF, and the supply of power source to the accessories and the like including the fuel injection system is stopped to temporarily stop the small boat. Since in this temporarily stopped state, the control unit (display control unit) can maintain the started-up state, the small boat call shift from the temporarily stopped state to a navigable state in a short time. As a result, the convenience of the small boat can be improved.

According to a third aspect of the present invention, the control unit (display control unit) is provided with a theft prevention function. When information for turning OFF the main relay is outputted from the control unit (display control unit), a stop signal for stopping the engine is caused to be outputted to the control unit (ECU) for controlling the engine on the basis of this OFF information.

When information for turning OFF the main relay is outputted from the control unit (display control unit), a stop signal for stopping the engine is caused to be outputted to the control unit (ECU) for controlling the engine on the basis of this OFF information. Thus, even when, for example, the main relay has been directly coupled, there is no possibility that the engine will start. Therefore, the small boat can be prevented from being stolen.

According to a fourth aspect of the present invention, when the main switch shifts from the ON-state to the OFF-state, the control unit (display control unit) instantaneously outputs a stop signal to the control unit (ECU), and that the engine is stopped by the control unit (ECU) on the basis of this stop signal. In addition, when the OFF-state of the main switch is within a predetermined time period, the control unit (display control unit) maintains the ON-state of the main relay.

When, for example, the main relay is turned OFF, the control unit (ECU) for controlling the engine is also often turned OFF. When starting up the power source, the control unit (ECU) may subject the display device and the accessories to fault diagnosis and the like in the same manner as the control unit (display control unit), and when the power source for the control unit (ECU) is turned OFF, it takes time for the small boat to shift to a navigable state.

More specifically, even when the engine is stopped to temporarily stop the small boat, the ON-state of the main relay is caused to be maintained if the OFF-state of the main switch is within a predetermined time period, whereby it is possible to shift from the temporarily stopped state to a navigable state in a short time.

According to a fifth aspect of the present invention, the control unit (display control unit) is an component part of a display device for displaying operation information of the small boat or boat hull information. After a lapse of a predetermined time period since the main switch shifts from the ON-state to the OFF-state, both the control unit (display control unit) and the main relay are switched from the ON-state to the OFF-state at the same time.

When the control unit (display control unit) is a component part of a display device for displaying operation information of the small boat or boat hull information of the small boat, both the control unit (display control unit) and the main relay are switched from the ON-state to the OFF-state at the same time. As a result, the state of the main relay can be grasped by the display function of the control unit (display control unit). Thus, the operator convenience can be improved.

Further scope of applicability of the present invention will become apparent from the detailed description given hereinafter. However, It should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, with reference to the accompanying drawings, the description will be made of embodiments according to the present invention.

Figure 1:
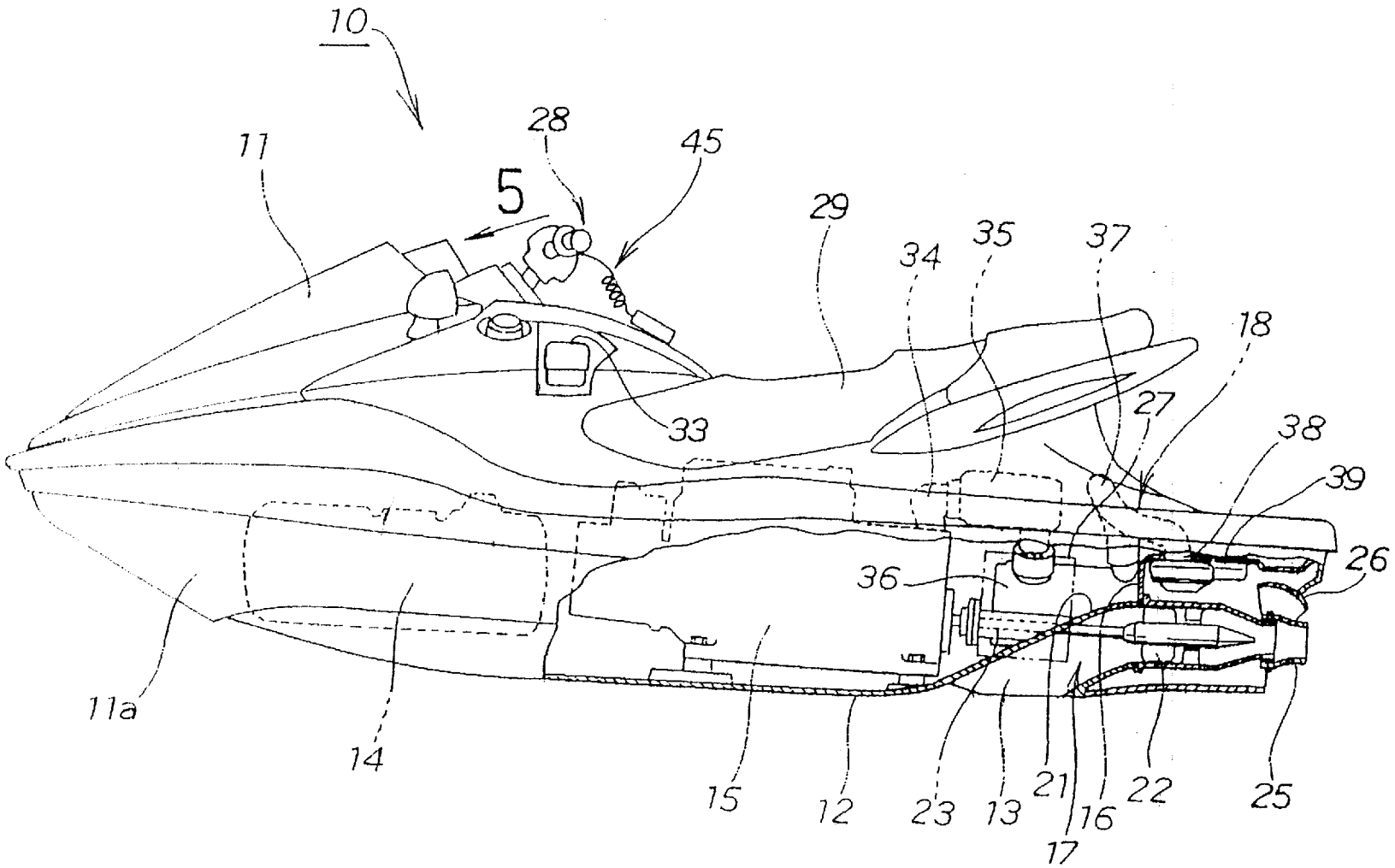
FIG. 1 is a side view showing a small boat onto which a power source system according to the present invention has been mounted.

FIG. 1 is a side view slowing a small boat onto which a power source system according to the present invention has been mounted. A jet propulsion boat 10 as a small boat according to the present invention is composed of a fuel tank 14 mounted to a front part 11*a* of a boat hull 11 and an engine 15 provided behind this fuel tank 14. A pump chamber 16 is provided behind the engine 15, and a jet propeller 17 is provided in this pump chamber 16. Also provided is an exhaust unit 18, the suction side of which is mounted to the engine 15, and the exhaust side of which is mounted to the pump chamber 16, a steering 28 mounted above the fuel tank 14, and a scat 29 mounted behind this steering 28.

The jet propeller 17 has a housing 21 extending backward from an opening 13 in a hull bottom 12. It is constructed such that an impeller 22 is rotatively mounted within this housing 21 and the impeller 22 is coupled to a driving shaft 23 of the engine 15.

In the jet propeller 17, the engine 15 is driven to rotate the impeller 22, whereby water drawn in through the opening 13 in the hull bottom 12 can be ejected backward of the boat hull 11 through a steering pipe 25 as a nozzle through an opening at real end of the housing 21.

The steering pipe 25 is a member mounted to the real end or the housing 21 so as to be able to freely swing in the lateral direction. The steering pipe is a nozzle for steering which controls the steering direction of the boat hull 11 by swinging in the lateral direction in the operational of the steering 28.

In this jet propulsion boat 10, fuel is supplied to the engine 15 from the fuel tank 14 to drive the engine 15. A driving force of this engine 15 is transmitted to the impeller 22 through the driving shaft 23 to rotate the impeller 22, whereby water is drawn in from the opening 13 in the hull bottom 12, and the water can be ejected through the steering pipe 25 through the rear end of the housing 21 for propelling the boat.

Also, as described later, the jet propulsion boat 10 is a boat hull equipped with a control unit in order to precisely control an amount of jet water stream or a duration during which jet water stream can be ejected. Further, this is also a boat hull capable of being switched into a limited operation mode, in which the engine output can be controlled so as not to exceed predetermined output.

FIG. 1 also shows a reverse bucket 26 which when reversing the boat hull, is put over the steering pipe 25 to flow the jet water stream forward obliquely downward. An operating knob 33 operates the reverse bucket 26. Other components include an exhaust pipe 34; an exhaust body 35; a battery 27 which is a power source for the boat hull 11, a water muffler 36, a water lock pipe 37, a tail pipe 38, a resonator 39, and a main switch 45 with lanyard switch.

Figure 2:
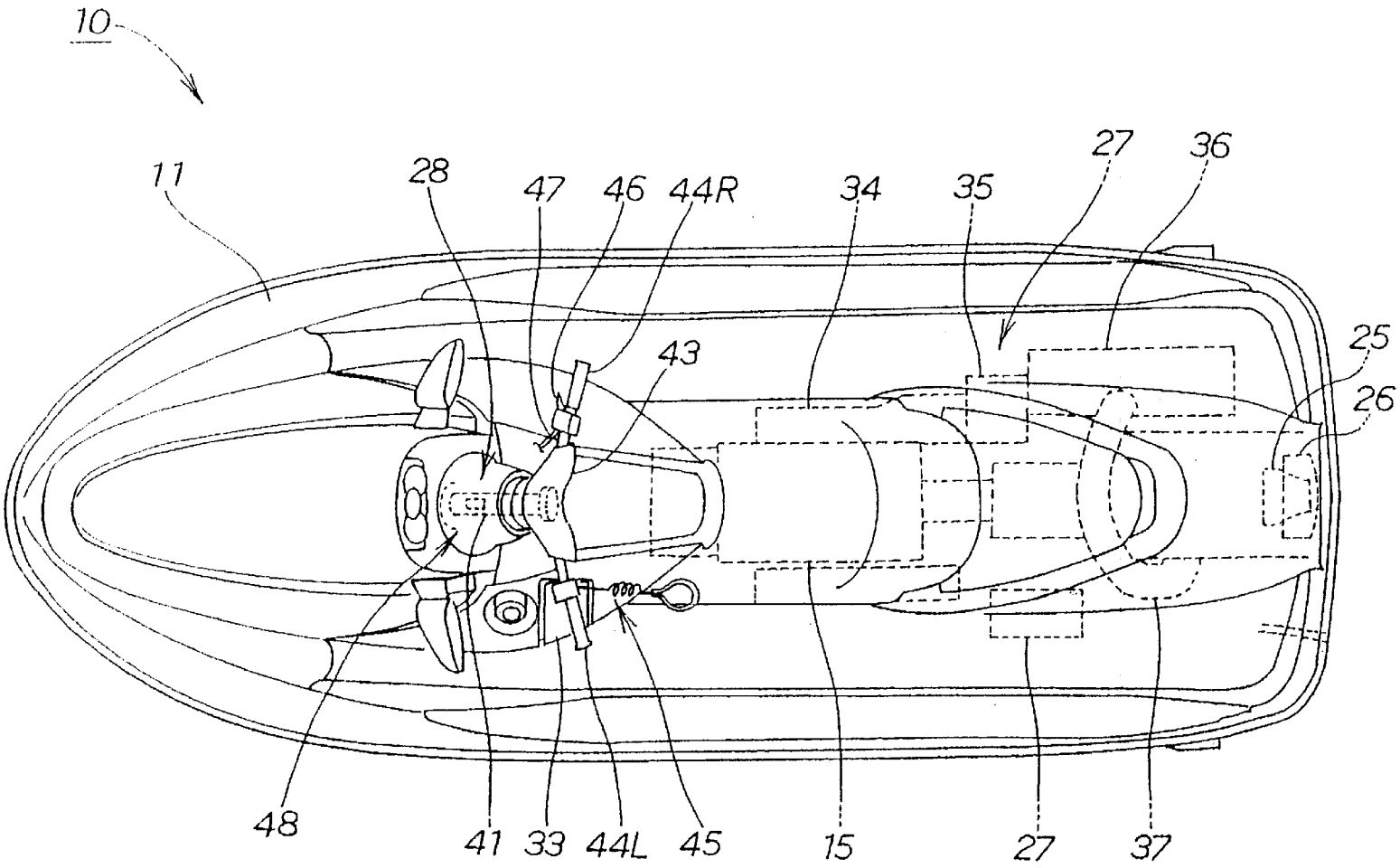
FIG. 2 is a plan view showing a small boat onto which a power source system according to the present invention has been mounted.

FIG. 2 is a plan view showing a small boat onto which a power source system according to the present invention has been mounted. The steering 28 is composed of: a steering shaft 41 rotatively mounted onto the boat hull, a steering wheel bar 43 to be mounted to the top end of this steering shaft 41, and right and left steering wheel grips 44L, 44R mounted onto the left and right end portions of this steering wheel bar 43. A main switch 45 with lanyard switch is provided at the base of the left steering wheel grip 44L, a throttle level 46 is mounted on the base of the right steering wheel grip 44R in such a manner as to be able to freely swing, a throttle cable 47 extends to the throttle from this throttle level 46, and a steering detection mechanism 48 is provided at the lower end of the steering shaft 41.

Figure 3:
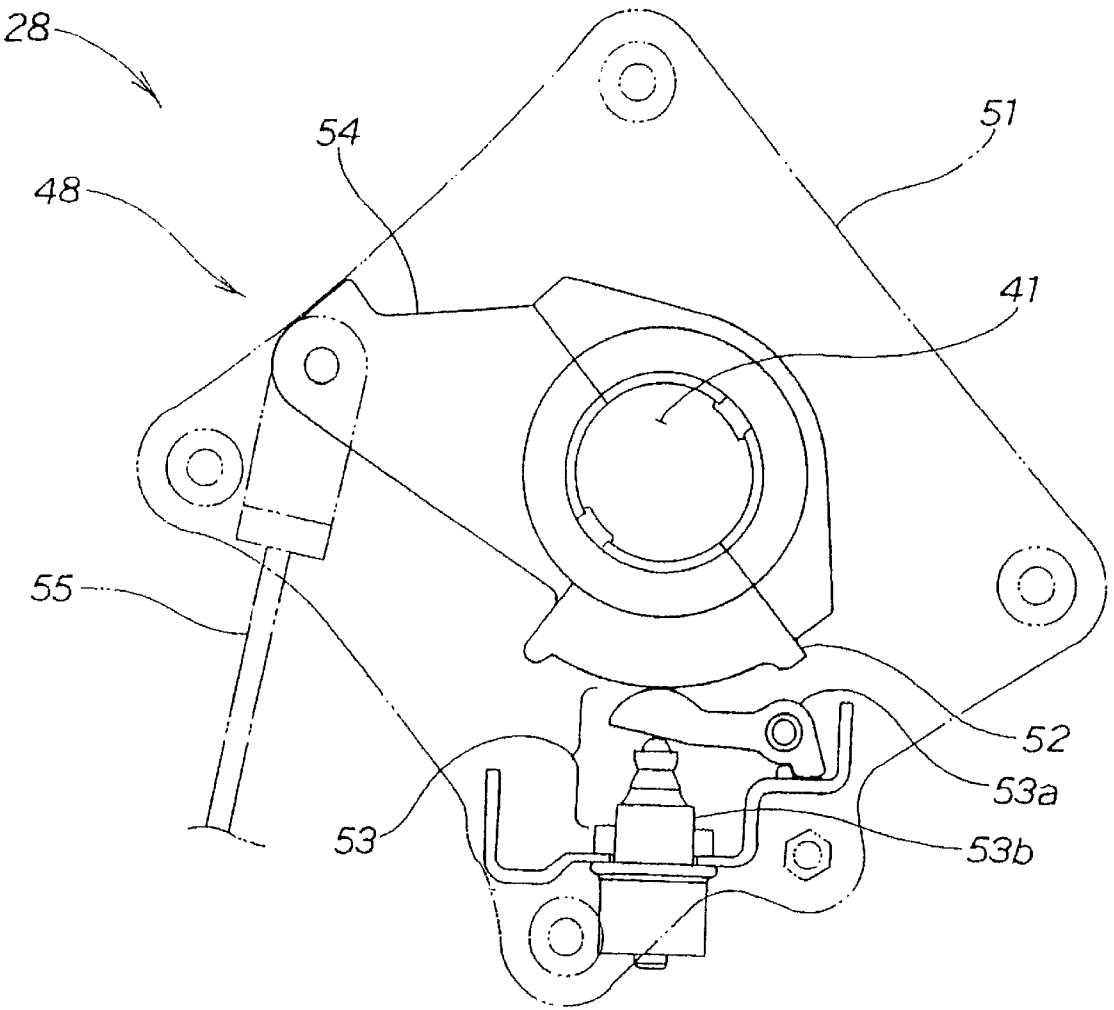
FIG. 3 is a plan view slowing a steering mechanism of a small boat onto which a power source system according to the present invention has been mounted.

FIG. 3 is a plan view showing a steering mechanism for a small boat onto which a power source system according to the present invention has been mounted. The steering detection mechanism 48 includes a bracket 51 mounted onto the boat hull 11 (See FIG. 1); a switch cam 52 mounted to the lower end of the steering shaft 41, a steering switch 53 for turning ON/OFF through the use of this switch cam 52, and a cam plate 54 mounted to the lower end of the steering shaft 41. A driving link 55 drives the steering pipe 25 (See FIG. 1) by rotatively mounting to the end portion of the cam plate 54. The STEERING switch 53 includes a switch lever 53*a* and a body portion 53*b*.

Figure 4:
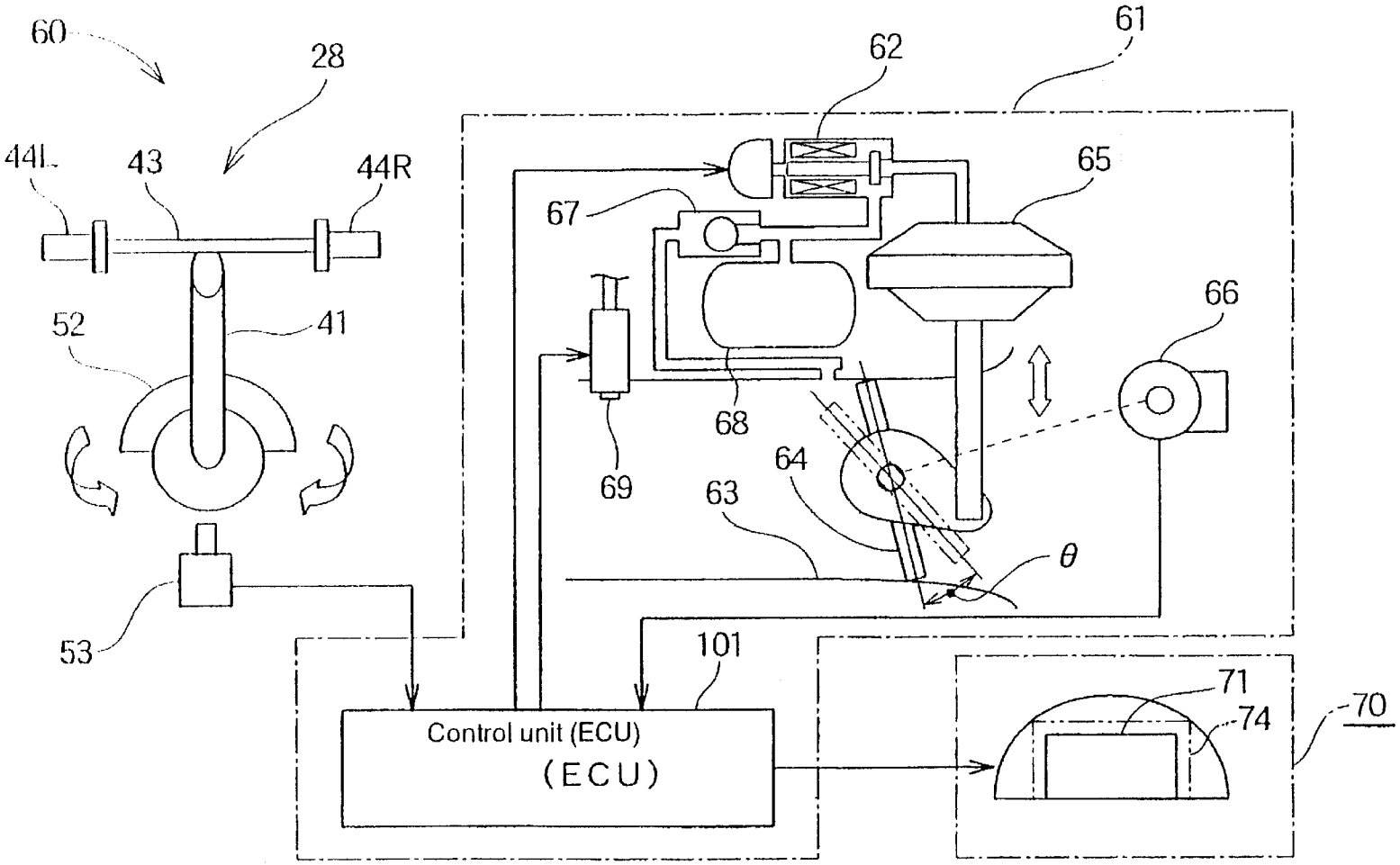
FIG. 4 is a block diagram showing an OTS control device of a small boat onto which a power source system according to the present invention has been mounted.

FIG. 4 is a block diagram showing an OTS control device for a small boat to which a power source system according to the present invention has been mounted. In this case, OTS is the abbreviated name for an off Throttle Steering System. The OTS a device in which a predetermined jet water stream is rendered capable of being maintained for a short period of time, even when the throttle 34 has been returned.

An OTS control device 60 for a jet propulsion boat is a system including the steering wheel 28 for steering the boat hull 11 (See FIG. 1), a fuel injection system 61 for supplying fuel to the engine 15 (See FIG. 1), a control unit (ECU) 101 for controlling the boat hull 11, and a display device 70 equipped with a display control unit 74 as a control unit, for displaying a state of the boat hull 11. This system raises the number of revolutions of the engine 15 to a predetermined number of revolutions irrespective of the throttle 64 when on condition that the engine 15 rotates at a predetermined number of revolutions or higher for a predetermined time period or more. The throttle 64 is opened at a predetermined opening or more for a predetermined time period or more, the throttle 64 is closed and at the same time, the steering wheel 28 is turned to the left or right more than a predetermined angle.

The fuel injection system 61 includes a solenoid 62 for controlling negative pressure on the basis of information from the control unit (ECU) 101, the throttle 64 provided in an intake air passage 63, for adjusting an amount of an air-fuel mixture to supplied to the engine 15 (See FIG. 1), a diaphragm 65 provided between these solenoids 62 and the throttle 64 for adjusting throttle opening, and a throttle position sensor 66 for detecting the throttle opening. A one-way valve 67 is provided between the solenoid 62 and the intake air passage 63, for preventing negative pressure from reverse-flowing, and pressure from entering, a surge tank 68 is provided between this one-way valve 67 and the solenoid 62, for relaxing negative pressure fluctuation, and an injector 69 for causing fuel to be in a fine spray state to supply to the intake air passage 63. In the figure, θ designates the throttle opening.

Figure 5:
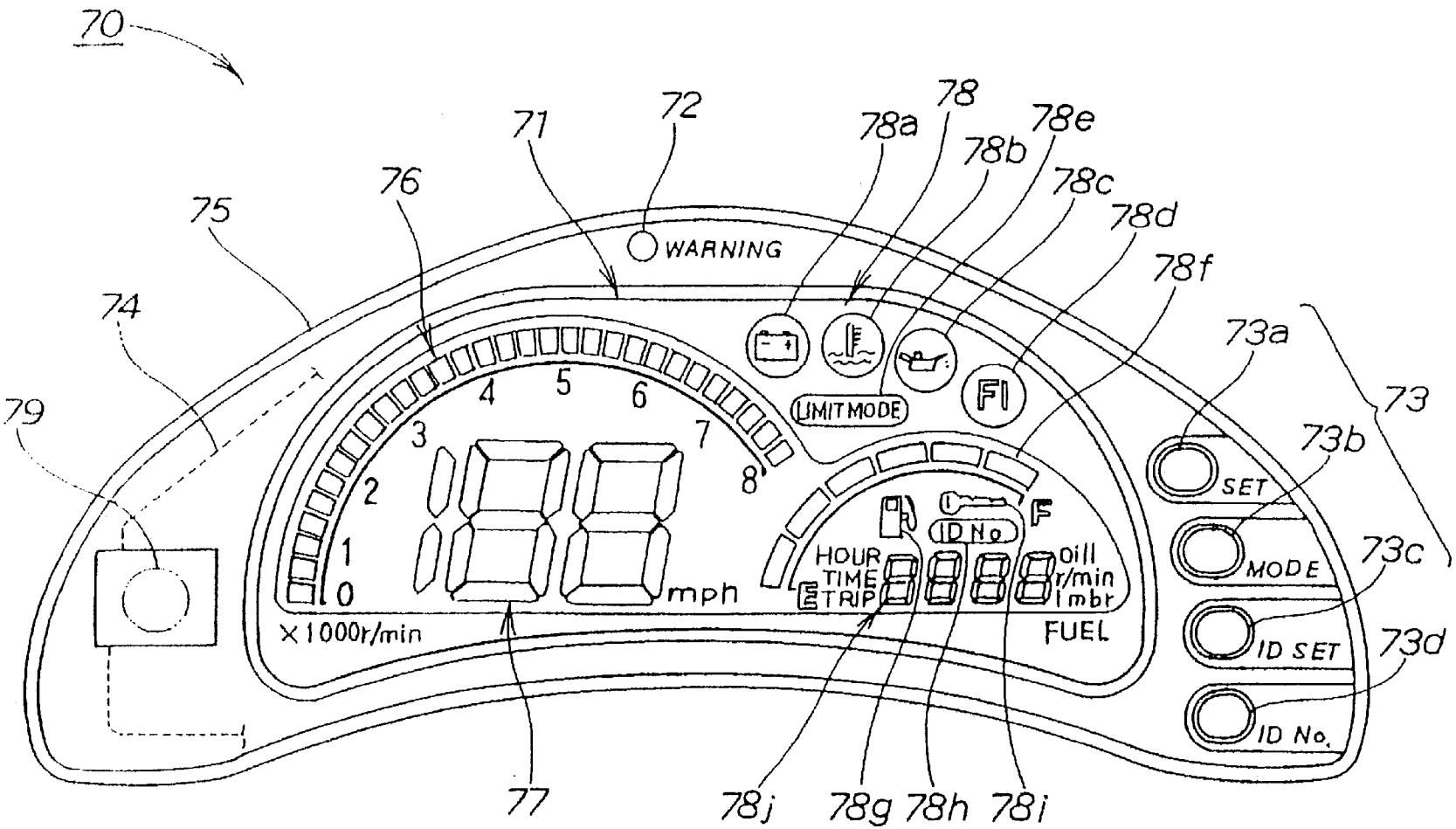
FIG. 5 is an arrow view taken on line 5 of FIG. 1.

FIG. 5 is an arrow view taken on line 5 of FIG. 1, and shows a front surface of a display device 70 (hereinafter, will be abbreviated as "display device 70") of a jet propulsion boat.

A display device 70 includes a liquid crystal device 71 as a liquid crystal display unit for displaying operation information, a warning lamp 72 for lighting or blinking when various warnings as boat hull information are necessary, and an operating switch 73 for performing a switching operation or an input operation; a display control unit 74 for driving the liquid crystal device 71 and the warning lamp 72 and controlling the boat hull 11. A housing 75 is provided for collectively covering the liquid crystal device 71, warning lamp 72 and display control unit 74. A buzzer 79 is provided for giving a warning sound when the warning lamp 72 lights or blinks.

The liquid crystal device 71 is obtained by forming a tachometer 76 for indicating a number of revolutions of the engine 15 (See FIG. 1), a speed meter 77 for indicating the boat speed, and a multifunctional display unit 78 for displaying operation information and various warning.

The multifunctional display unit 78 includes a charging mark 78*a* for blinking when the battery 27 (See FIG. 1) is lower than predetermined voltage, and a water temperature warning mark 78*b* for blinking when cooling water temperature exceeds a predetermined temperature; an oil warming mark 78*c* for blinking when an amount of engine oil is lower than a predetermine amount, or when engine oil pressure is lower than a predetermined value; a fuel injection system warning mark 78*d* (hereinafter, will be abbreviated as "Fl warning mark 78*d*") for blinking when abnormal conditions are encountered with the fuel injection system 61 (See FIG. 3). Also included are a limit mode indicating mark 78*e* as an indicating lamp indicating that a limited operation mode which limits the engine output so as not to exceed the predetermined output has been set; a remaining quantity indicator 78*f* for indicating the remaining fuel quantity, a fuel replenish warning mark 78*g* for urging to replenish fuel when the remaining fuel quantity is small; an ID number mark 78*h* for blinking when an ID (Identification) number as a secret number for theft prevention is set and is locked; a key mark 78*i*, a key mark 78*i* for lighting when the theft-prevention function has been released, a selector display unit 78*j* for displaying after switched to time indication, hours underway indication, the number of engine revolutions (hereinafter, will abbreviated as "Ne tacho-indication"), navigation distance indication or cumulative hours underway indication.

In other words, the jet propulsion boat 10 (See FIG. 1) is also a propulsion boat equipped with a theft-prevention function, the power source of which can be turned ON or OFF by inputting the ID number.

The operating switch 73 is composed of a set switch 73*a* to be used when setting time, the mode switch 73*b* to be used when switching the selector display unit or when setting the limited operation mode, and the ID set switch 73*c* and the ID number switch 73*d* to be used when encoding with an ID number for determination.

Figure 6:
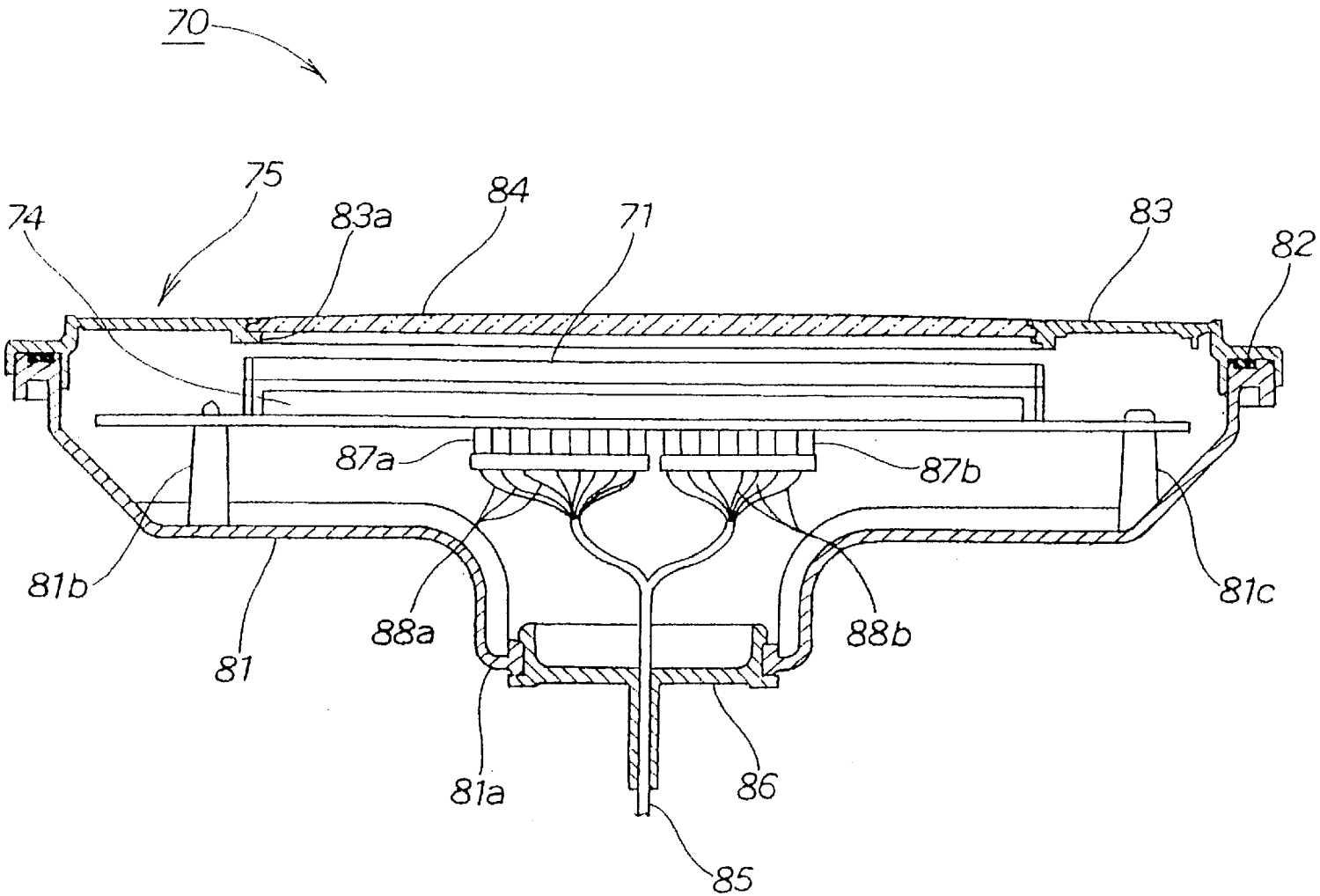
FIG. 6 is a plane cross-sectional view showing a display device for a small boat according to the present invention.

FIG. 6 is a plane cross-sectional view showing a display device for a small boat onto which a power source system according to the present invention has been mounted. A housing 75 is composed of a lower case 81 for mounting a display control unit 74, an upper case 83 mounted to this lower case 81 through a packing 82, a display window 84 mounted onto an opening 83*a* of this upper case 83, and a bush 86 provided to draw out a harness 85 obtained by tying up in a bundle from the bottom 81*a* of the lower case 81.

FIG. 6 also shows a boss 81*b* for supporting the display control unit 74 by standing it in the lower case 81, a set boss 81*c* for fastening the display control unit 74 by standing it in the lower case 81, connectors 87*a*, 87*b* connected to the display control unit 74, and a plurality of harnesses 88*a*, 88*b* extending from the display control unit 74.

Figure 7:
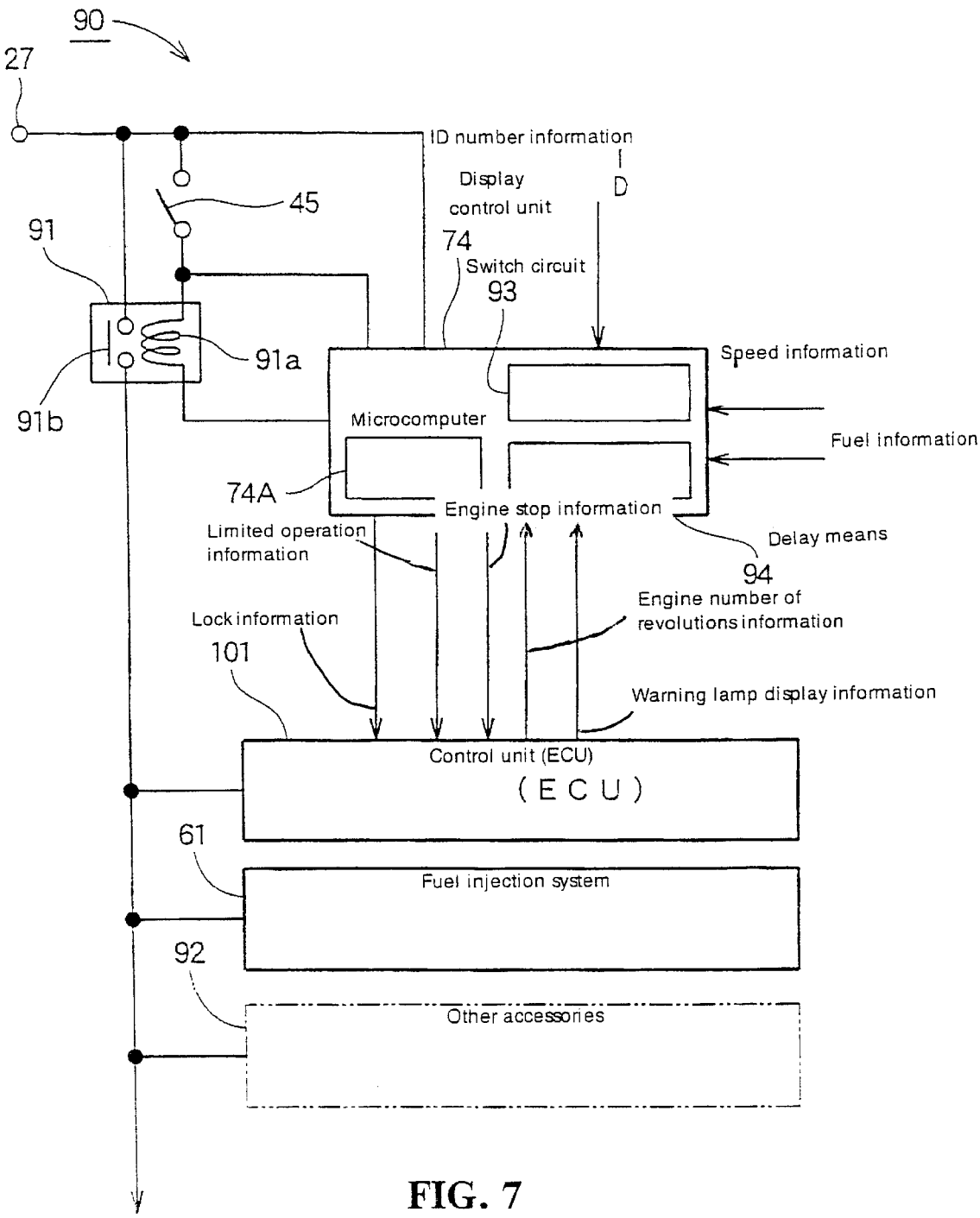
FIG. 7 is a block diagram showing a power source system for a small boat according to the present invention.

FIG. 7 is a block diagram showing a power source system for a small boat according to the present invention. The power source system 90 includes a main switch 45 with lanyard switch connected to a battery 27 power source in parallel, a main relay 91 for turning ON/OFF the battery 27 power source for supplying to the fuel injection system 61 and other accessories 92 (fuel pump to be described later) by connecting a coil portion 91*a* to this main switch 45 in series and connecting a switch portion 91*b* to the battery 27 in series, the display control unit 74 which connects to the main switch 45 in parallel in order to control this main relay 91; and the control unit (ECU) 101 for controlling the engine 15 (See FIG. 1) having the fuel injection system 61 and the like.

The control unit (ECU) 101 is a portion which controls the engine 15 and controls the jet propulsion boat 10 (See FIG. 1) which controls the fuel injection system 61 and other accessories 92.

The display control unit 74 has a microcomputer 74A which forms the heart, a switching circuit 93 for turning ON/OFF the power source of the display control unit 74 itself by inputting information of the main switch 45 with a lanyard switch and a predetermined ID number, and delay means 94 for delaying the operation of this switching circuit 93 by a predetermined time period. The display control unit 74 inputs ID information for theft prevention; information of the state of the main switch 45 with a lanyard switch and speed of the boat hull, fuel information for displaying the remaining quantity of fuel, information of number of revolutions of the engine, warning lamp display information for lighting a multifunctional display unit 78 shown in FIG. 5 and the warning lamp 72, and the like to output limited operation information when a limited operation is performed by controlling the fuel injection system 61 (See FIG. 4), locking information which turns OFF the main relay 91, and engine stop information. FIG. 7 also shows other accessories 92.

More specifically, the power source system for a small boat is equipped with a main switch 45 with a lanyard switch capable of turning OFF power source in case of an emergency by connecting to all occupant by wire, for supplying a power source to a control unit (ECU) 101 and the like which control accessories and all engine 15 (See FIG. 1) including a fuel injection system 61. The power source system 90 may be said to have a main relay 91 for turning ON/OFF a power source to be supplied to the control unit (ECU) 101 and the like which control the accessories and the engine, and a control unit (display control unit 74) connected to the main switch 45 in parallel in order to control this main relay 91, and to monitor an ON/OFF state of the main switch 45 through the use of the control unit (display control unit 74) for ON/OFF controlling the main relay 91 on the basis of the ON/OFF state.

A main relay 91 is provided in order to turn ON/OFF the power source to be supplied to the control unit (ECU) 101 and the like which control the accessories and the engine 15 (See FIG. 1) including the fuel injection system 61. In order to control this main relay 91, a control unit (display control unit 74) is connected to the main switch 45 in parallel. The design is such that an ON/OFF state of the main switch 45 is monitored through the use of the control unit (display control unit 74) and the main relay 91 is turned ON/OFF on the basis of the ON/OFF state. Therefore, it is possible to collectively control the ON/OFF of the power source to be supplied to the control unit (ECU) 101 and the like for controlling the accessories and the engine 15 including the fuel injection system 61. As a result, the power source system 90 can be simplified.

Also, the display control unit 74 outputs to the control unit (ECU) 101 lock information when the main relay 91 is OFF. Therefore, since the control unit (ECU) 101 has the lock information, the engine 15 (See FIG. 1) cannot be started even though the main relay 91 is directly connected.

More specifically, the control unit (display control unit 74) is provided with a theft prevention function. The design is such that when information for turning OFF the main relay 91 is outputted from the control unit (display control unit 74), a stop signal for stopping the engine 15 is outputted to the control unit (ECU) 101 for controlling the engine 15 on the basis of this OFF information.

When information for turning OFF the main relay 91 is outputted from the control unit (display control unit 74), a stop signal for stopping the engine 15 is outputted to the control unit (ECU) 101 for controlling the engine 15 on the basis of this OFF information. Thus, even when, for example, the main relay 91 has been directly coupled, there is no possibility that the engine 15 can be started. Therefore, the small boat (jet propulsion boat 10) can be prevented from being stolen.

Figure 8:
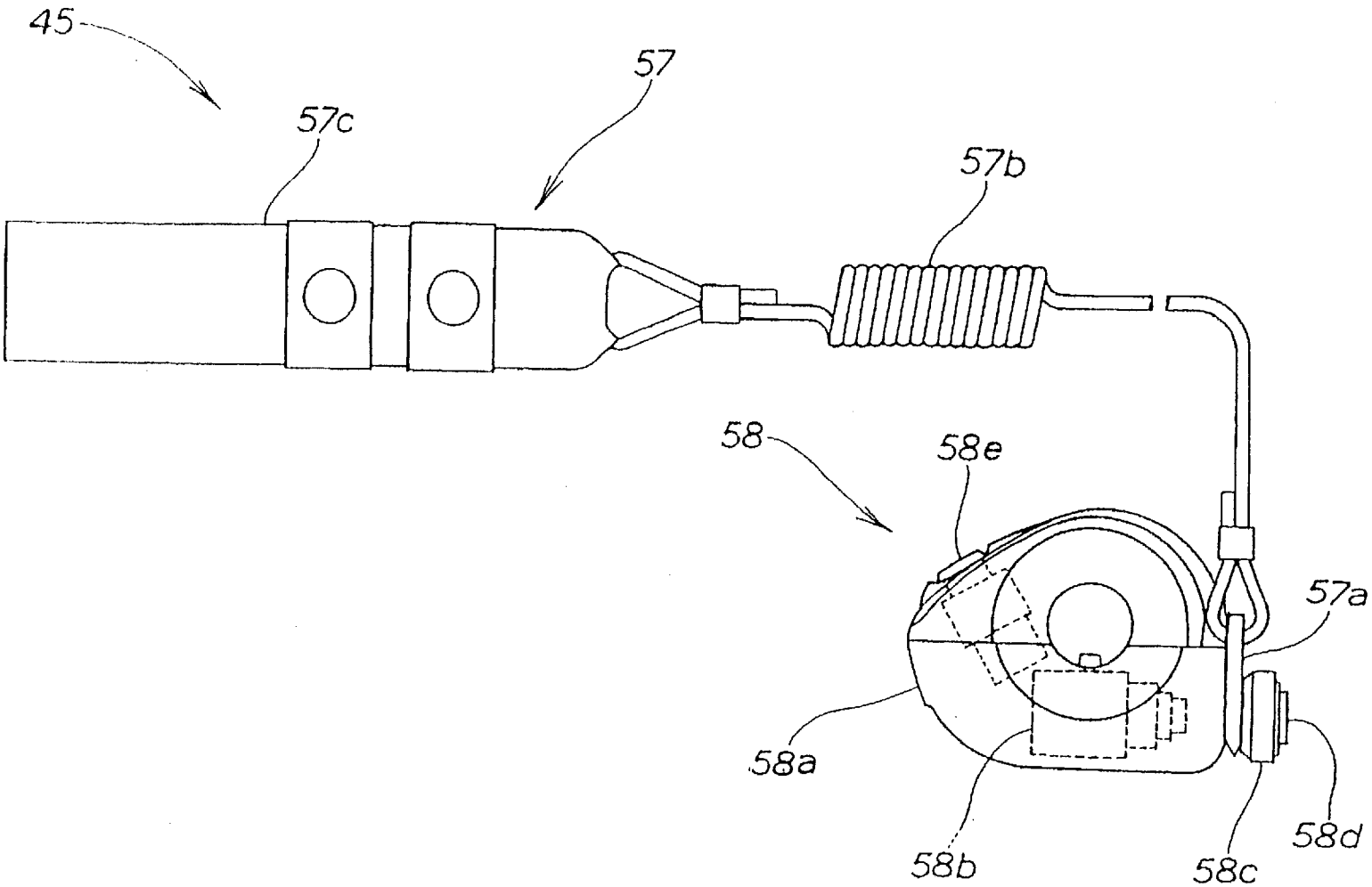
FIG. 8 is a side view showing a main switch with lanyard switch for a small boat onto which a power source system according to the present invention has been mounted.

FIG. 8 is a side view showing a main switch with lanyard switch of a small boat onto which a power source system according to the present invention has been mounted. The main switch 45 with lanyard switch is composed of a lanyard switch portion (switch operation strap) 57 to be connected to the occupant during navigation, and a main switch body portion 58 capable of being ON/OFF operated by this lanyard switch.

The lanyard switch portion 57 is composed of a clip portion 57*a* for turning ON/OFF the power source by sandwiching it in the main switch body portion 58 or removing; a flexible wire 57*b* extending from this clip 57*a*, and a hand strap 57*c* to be worn on the occupant's arm by mounting to the tip end of this wire 57*b*.

The main switch portion 58 is composed of a housing 58*a* to be mounted on the boat hull 11 (See FIG. 1) side, a switch

58*b* housed in this housing 58*a,* an outer knob 58*c* for operating this switch 58*b,* a stop button 58*d* provided inside this outer knob 58*c,* and a start switch 58*e* for starting the engine 15 (See FIG. 1).

The main switch portion 58 is a switch which turns ON the switch 58*b* when the outer knob 58*c* is pulled outward, maintains ON when the clip 57*a* of the lanyard switch portion 57 is sandwiched, automatically returns to the initial position to turn OFF when the clip 57*d* comes off, and can turn OFF the power source by pressing the stop button 58*d* with the clip 57*a* sandwiched. Hereinafter, the detailed description will be made of an operation of the main switch 45 with lanyard switch.

Figure 9A:
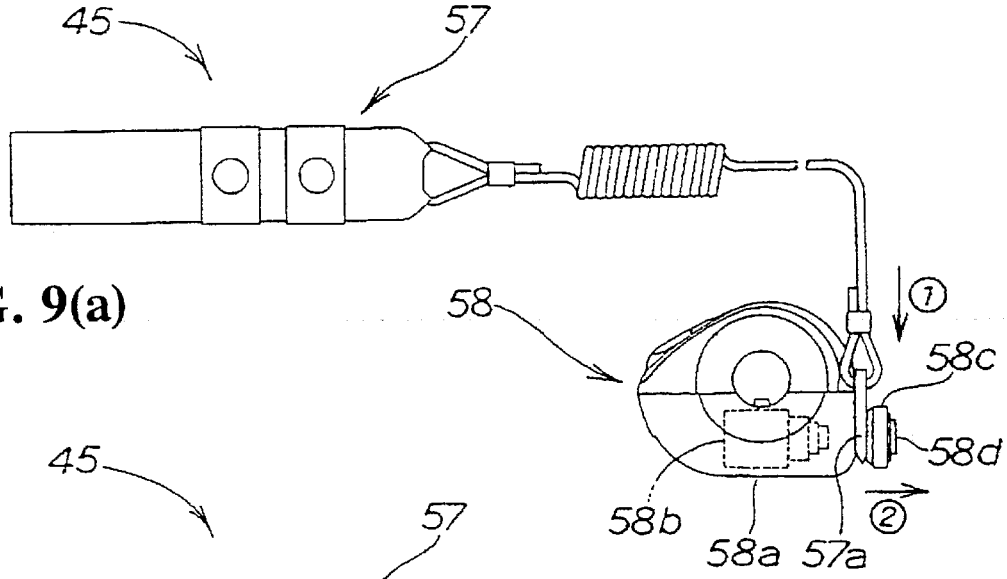
FIGS. 9(*a*)–(*c*) are operational views showing a main switch with lanyard switch for a small boat onto which a power source system according to the present invention has been mounted.
Figure 9B:
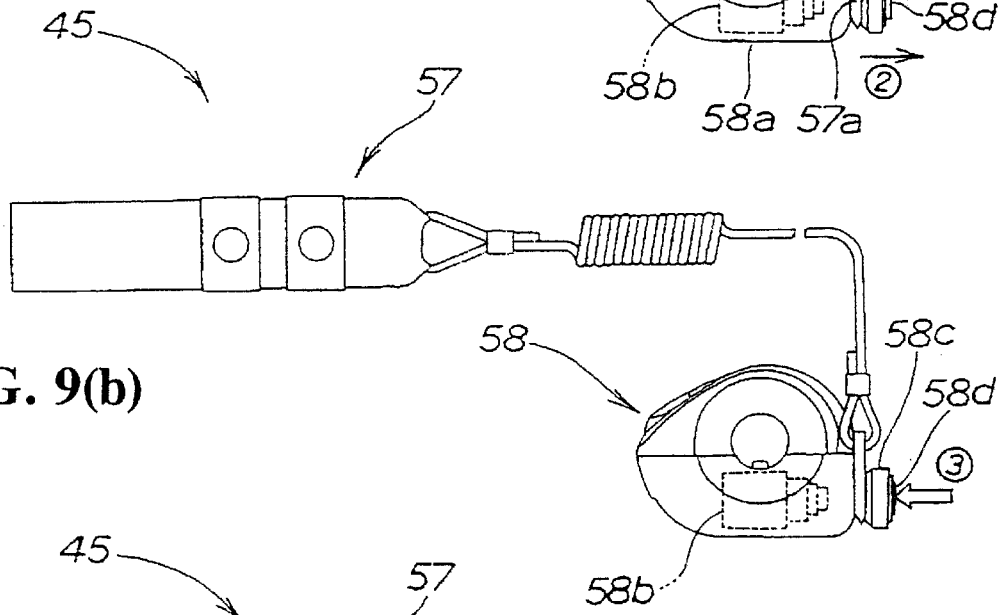
Figure 9C:
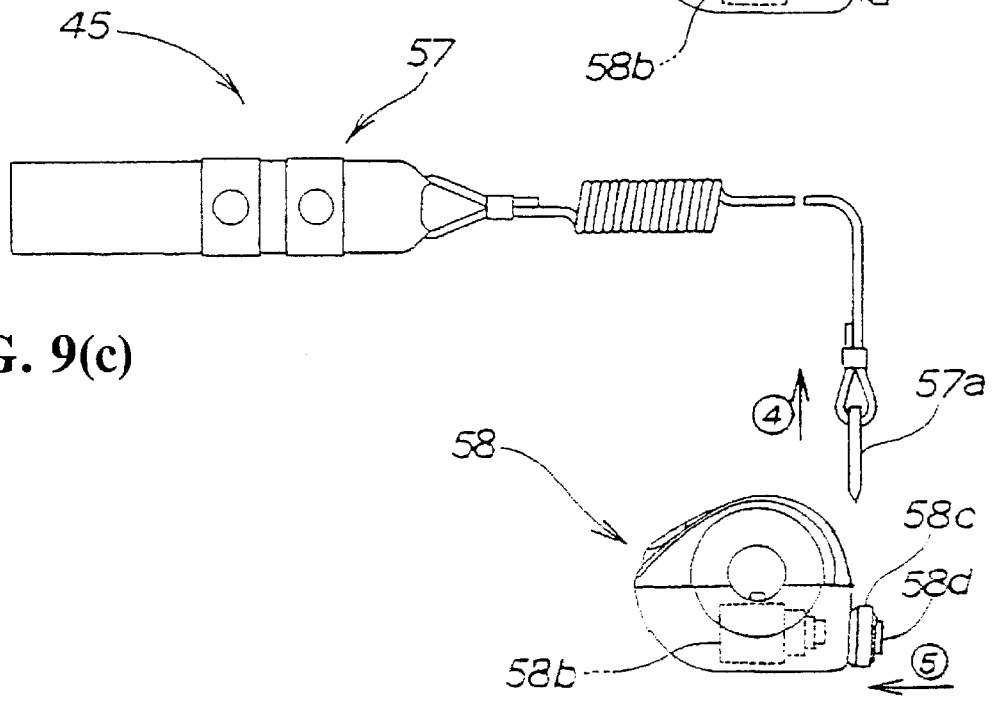

FIGS. 9(*a*) to 9(*c*) are operating views of the main switch with lanyard switch for a small boat onto which a power source system according to the present invention has been mounted.

In FIG. 9(*a*), the clip 57*a* of the lanyard switch portion 57 is pressed into between the housing 58*a* of the main switch body portion 58 and the outer knob 58*c* as indicated by an arrow (1), whereby the outer knob 58*c* moves as indicated by an arrow (2), and the switch 58*b* can be turned ON.

In FIG. 9(*b*), the stop button 58(*d*) is pressed as indicated by an arrow (3) with the lanyard switch portion 57 fitted in the main switch body portion 58, whereby the switch 58*b* can be turned OFF.

In FIG. 9(*c*), when the clip 57*a* of the lanyard switch portion 57 is pulled out between the housing 58*a* of the main switch body portion 58 and the outer knob 58*c* as indicated by an arrow (4), the outer knob 58*c* automatically returns together with the stop button 58*d* as indicated by an arrow (5), and the main switch body portion 58*b* turns OFF.

Figure 10A:
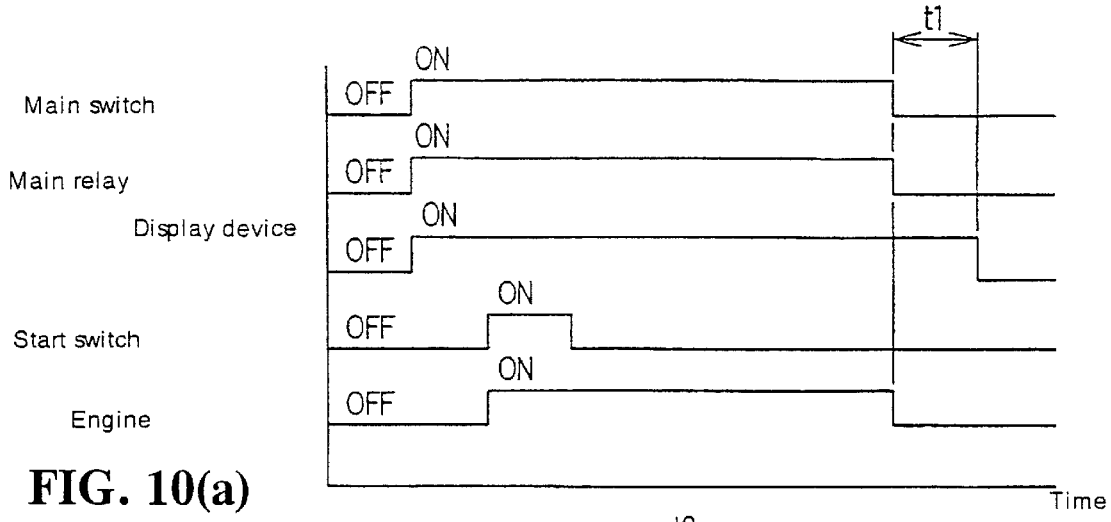
FIGS. 10(*a*)–(*c*) are explanatory view of the operation of a power source system for a small boat according to the present invention.
Figure 10B:
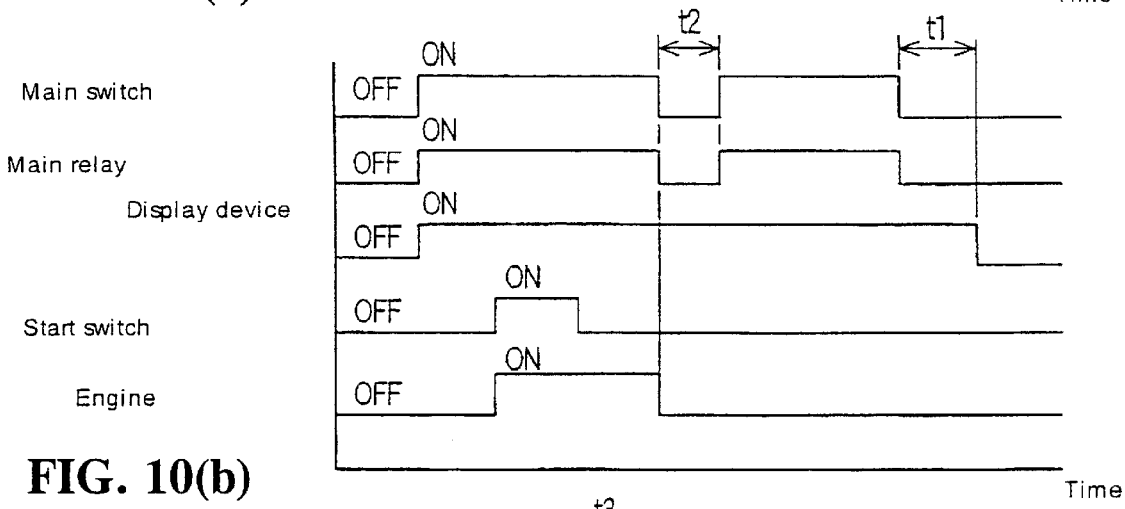
Figure 10C:
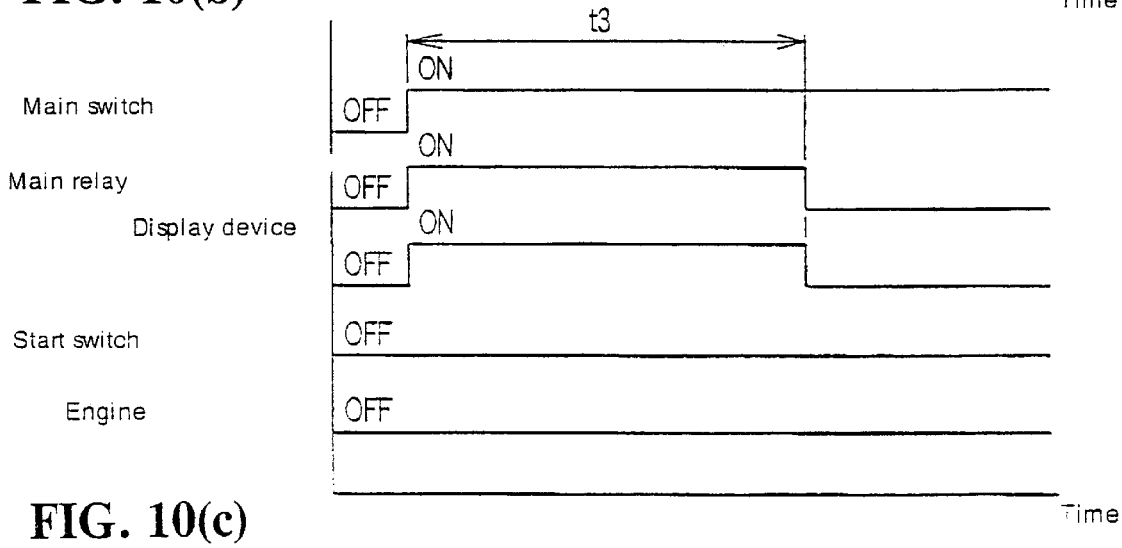

FIGS. 10(*a*) to 10(*c*) are explanatory views of the operation of a power source system for a small boat according to the present invention, showing relationship in an operating state between a main relay, the display device, a start switch and the engine (for reference numerals, refer to FIG. 8).

FIG. 10(*a*) shows operation relationship when the lanyard switch 57 has been pulled out, that is, at the termination of the navigation or at the time of drainage of pounded water.

First, as illustrated in FIGS. 9(*a*) to 9(*c*), the lanyard switch portion 57 is fitted the main switch body portion 58, whereby the main switch 45, the main relay 91 (See FIG. 7) and the display device 70 turn ON in synchronism. Pressing the start switch 58*e* (See FIG. 4) starts the engine 15 (See FIG. 1).

Next, when the lanyard switch 57 is pulled out of the main switch body portion 58, the main switch 45, the main relay 91 and the engine 15 turn OFF in synchronism. The display device 70 turns OFF (controlled by delay means 94 equipped for the display control unit 74 as shown in FIG. 7) after a predetermined time period t1. Here, the predetermined time period t1 has been set to 10 sec.

FIG. 10(*b*) shows operation relationship when the engine 15 is stopped without pulling the lanyard switch portion 57 out, that is, when in the case of taking a seat for standby and the like, the stop button 58*d* is pressed to turn OFF the main switch 45, and the main switch 45 is turned ON within time period t2 (t2<t1). Since the display device 70 has been caused to be able to maintain the ON-state during time period t1 since the main switch 45 was turned OFF as shown in FIG. 9(*a*), only the engine 15 is stopped by the above-described operation, and the display device 70 stands by while ON is maintained. The display control unit 74 equipped for the display device 70 enters a trouble inspection mode when the display device 70 is turned ON. Therefore, it takes time to start up the display device 70. Accordingly, the engine 15 is stopped for standing by, and when the start switch 58*e* is pressed, the navigation of the boat may commence immediately.

FIG. 10(*c*) shows the operation relationship when the lanyard switch 57 is not pulled out, but is left standing.

When a predetermined time period t3 has elapsed with the engine 15 turned OFF, and the main switch 45, the mini relay 91 and the display device 70 are turned ON, the main relay 91 and the display device 70 are automatically caused to turn OFF (controlled by a switch circuit 93 equipped for the display control unit 74 shown in FIG. 7) through the use of the display control unit 74 so as to restrain unnecessary power consumption of the battery 27 (See FIG. 1).

When the main switch 45 shifts from the ON-state to all OFF-state, the power source system 90 (See FIG. 4) may be said to cause the main relay 91 to be instantaneously switched from ON to OFF, and the control unit (display control unit 74) to maintain the ON-state in the OFF-state of the main switch 45 during a predetermined time period.

For example, when starting up the power source, the control unit often causes the display device and the accessories to be subjected to fault diagnosis and the like. Therefore, when the power source for the control unit is carelessly dropped, it takes time to start up the control unit.

Thus, in the OFF-state of the main switch during a predetermined time period, the control unit maintains the ON-state, whereby the main switch 45 (See FIG. 4) is switched to the OFF-state, the main relay 91 is instantaneously switched to OFF, and the supply of power source to the accessories including the fuel injection system 61 and the like is stopped to temporarily stop the jet propulsion boat 10 (See FIG. 1). Since in this temporarily stopped state, the control unit (display control unit 74) can maintain the started-up state, the jet propulsion boat 10 can shift from the temporarily stopped state to a navigateable state in a short time. As a result, the convenience of the jet propulsion boat 10 can be improved.

Figure 11:
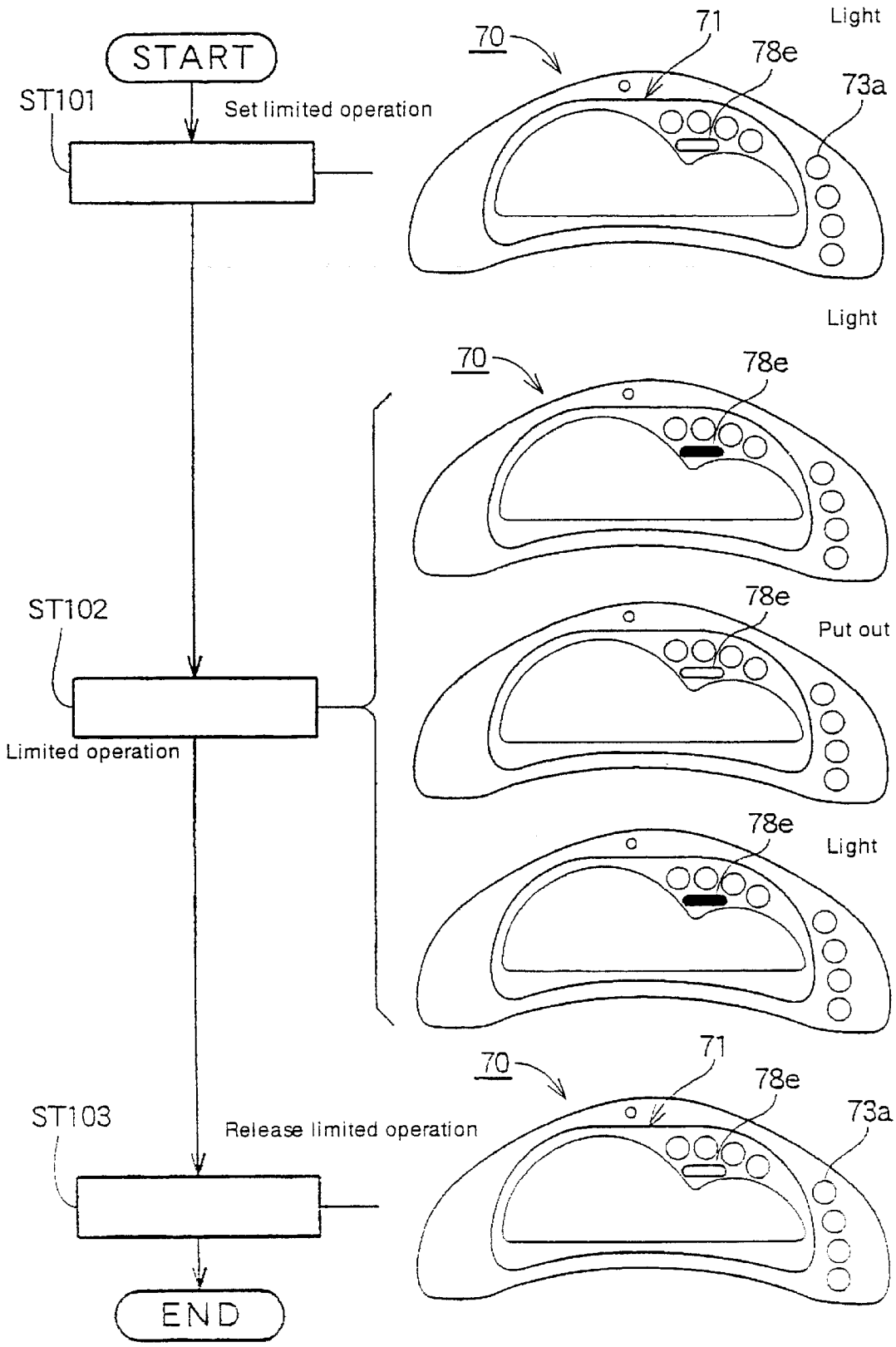
FIG. 11 is a flow chart for setting a limited operation for a small boat onto which a power source system according to the present invention has been mounted.

FIG. 11 is a flow chart showing limited operation setting for a small boat onto which a power source system according to the present invention has been mounted. In this respect, STxxx designates a step number.

ST101: Set to a limited operation mode in which the output of the engine 15 (See FIG. 1) is limited low. Specifically, continuously depress a set switch 73*a* of the display device 70. To continuously depress is to continue depressing the set switch 73*a* for five or more seconds. In this respect, the set switch 73*a* is also another functional setting switch for the present time setting and the like.

In other words, by setting to a limited operation, a limit mode display mark 78*e* is caused to light for displaying.

ST102: During the limited operation, the limited mode display mark 78*e* is caused to blink for displaying that the output of the engine 15 is limited in the limited operation.

ST103: Release the limited operation mode. Specifically, continuously depress the set switch 73*a* of the display device 70. The limited mode display mark 78*e* will be put out.

In a small boat (et propulsion boat 10) equipped with a display panel (liquid crystal device 71) displaying operation information and a change-over switch (set switch 73*a*) capable of switching from a normal operation in which output of the engine 15 (See FIG. 1) is not limited to a limited operation in which the output of the engine 15 is limited to operate at a limited level. The display device 70 may also be display device having a display lamp (limited mode display mark 78*e*) for lighting when switched to the limited operation as a display panel (liquid crystal device 71).

For example, it is assumed that when a small boat (jet propulsion boat 10) capable of switching from a normal operation in which output of the engine 15 (See FIG. 1) is not limited to a limited operation in which the output of the engine 15 is limited low is steered in the limited operation, the throttle 64 (See FIG. 4) has been opened in order to increase the boat speed. At this time, when the operator's awareness that the small bolt is under the limited operation is assumed to decline. Thus, the operator may think that the small boat (jet propulsion boat 10) is not operating properly.

Thus, for the convenience of the operator, a display lamp (limit mode display mark 78*e*) is provided for displaying that the engine has been switched from the normal operation, in which output of the engine 15 is not limited, to the limited operation in which the output of the engine 15 is limited.

Also, the display device 70 may be a display device with a display lamp (limit mode display mark 78*e*) that blinks during the limited operation, that is, when the number of revolutions of the engine 15 reaches a predetermined number of revolutions or more and the output of the engine 15 is limited.

When the display lamp (limit mode display mark 78*e*) blinks during the limited operation, it can gives on the operator a clear signal that the engine operation is limited.

Further, in the display device 70, the change-over switch (set switch 73*a*) may also serve as a functional change-over switch for the display panel (liquid crystal device 71).

The change-over switch (set switch 73*a*) serves dually as a functional change-over switch for the display panel (liquid crystal device 71), whereby the operation function can be made multifunctional. Thus, the display device 70 can be miniaturized.

Figure 12:
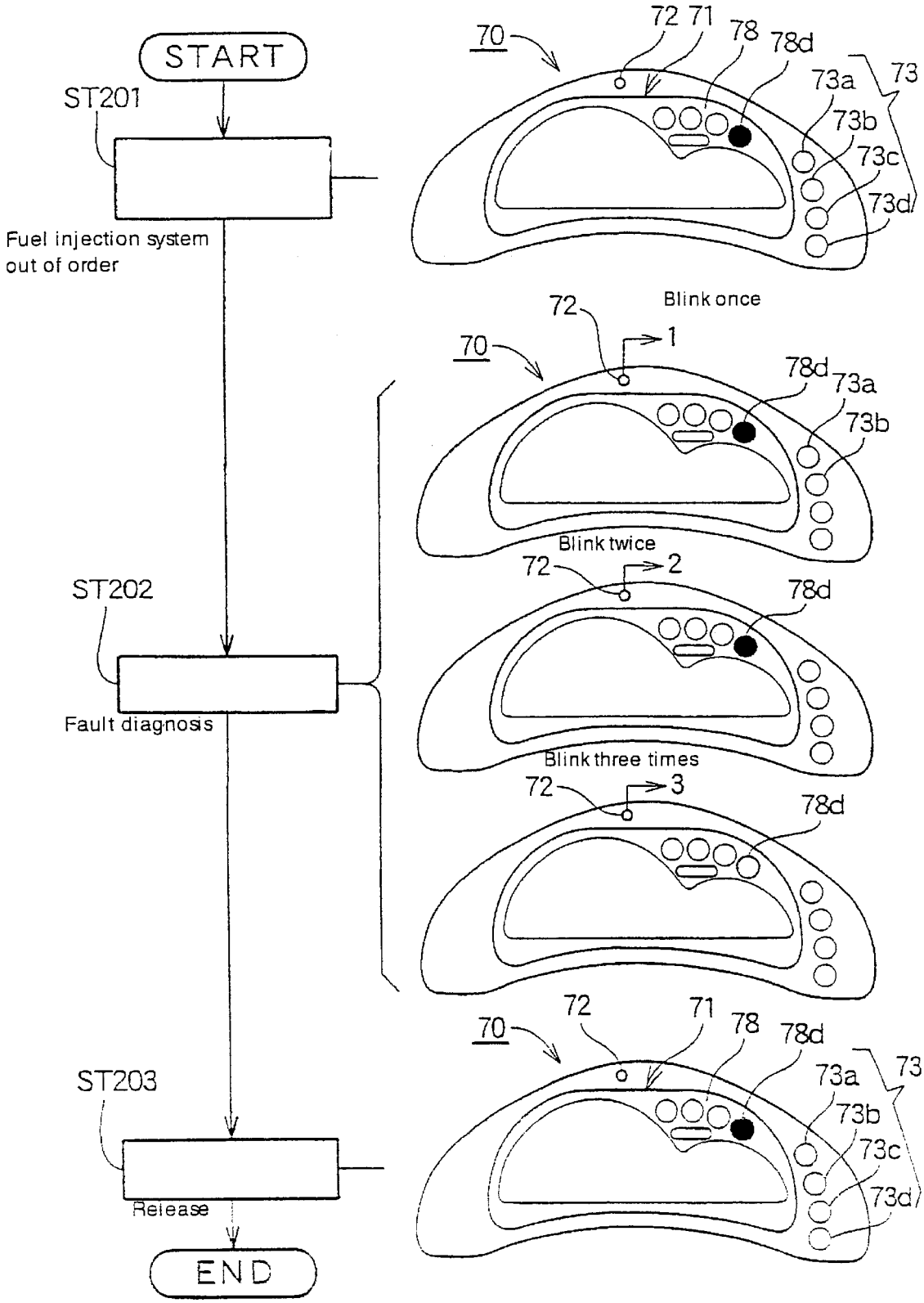
FIG. 12 is a flow chart for showing a procedure of fault diagnosis for a small boat onto which a power source system according to the present invention has been mounted.

FIG. 12 is a flow chart shoving fault diagnosis procedure for s small boat onto which a power source system according to the present invention has been mounted. In this respect, STxxx designates a step number.

ST201: Lighting of a F1 warning mark 78*d* provides notification that the fuel injection system 61 (See FIG. 3) is out of order.

ST202: Perform fault diagnosis. Specifically, continuously depress both the set switch 73*a* and the mode switch 73*b* of the display device 70 at the same time.

When the warning lamp 72 blinks once, it shows that the negative pressure in the intake air passage 63 (See FIG. 4) is out of order. When the warning lamp 72 blinks twice, it shows that the throttle link 47 (See FIG. 3) is out of order. When the warning lamp 72 blinks three times, it shows that the fuel pump (not shown) is out of order. Thus, each of these potential trouble points can be identified immediately.

ST203: Release the above-described fault diagnosis mode. Specifically, press the mode switch 73*b*. It will be automatically released after a lapse of 30 seconds without signal.

The jet propulsion boat 10 is equipped with a multifunctional display unit 78 displaying operation information and various warnings, and an operating switch 73 for operating display content of this multifunctional display unit 78. Also provided is a fuel injection system 61 (See FIG. 4) for injecting fuel into a driving source. The display device 70 may be a display device in which the multifunctional display unit 78 is provided with the warning lamp 72 for warning that the fuel injection system 61 is out of order. This warning lamp 72 is arranged to light or blink. When the warning lamp 72 lights or blinks, a function to display an abnormal symptom is provided by means of a blinking pattern (such as, for example, blinking once, blinking twice or three times) by operating the operating switch 73.

Generally, the fuel injection system is a device for mixing air with fuel to supply an air-fuel mixture vaporized into the engine. Therefore, for example, when the fuel injection system is out of order, it is difficult to distinguish whether the intake air system is out of order, the fuel supply system is out of order, or the other portions are out of order.

To address this issue, the warning lamp 72 is provided for warning, that the fuel injection system 61 (See FIG. 4) is out of order, which notifies of the abnormality of the fuel injection system 61. Also, this warning lamp 72 is caused to lilt or blink, whereby it emphasizes that the fuel injection system 61 is out of order.

Further, a function for displaying the abnormal symptom is provided through the use of the blinking pattern by operating the operating switch 73 when the warning lamp 72 lights or blinks. As such, an immediate measure can be taken to cope with the trouble with the fuel injection system 61.

In other words, since the function for displaying the abnormal symptom is provided through the use of the blink pattern by operating the operating switch 73 and the warning lamp 72 lights or blinks, troubleshooting of the fuel injection system 61 becomes much more convenient.

Figure 13:
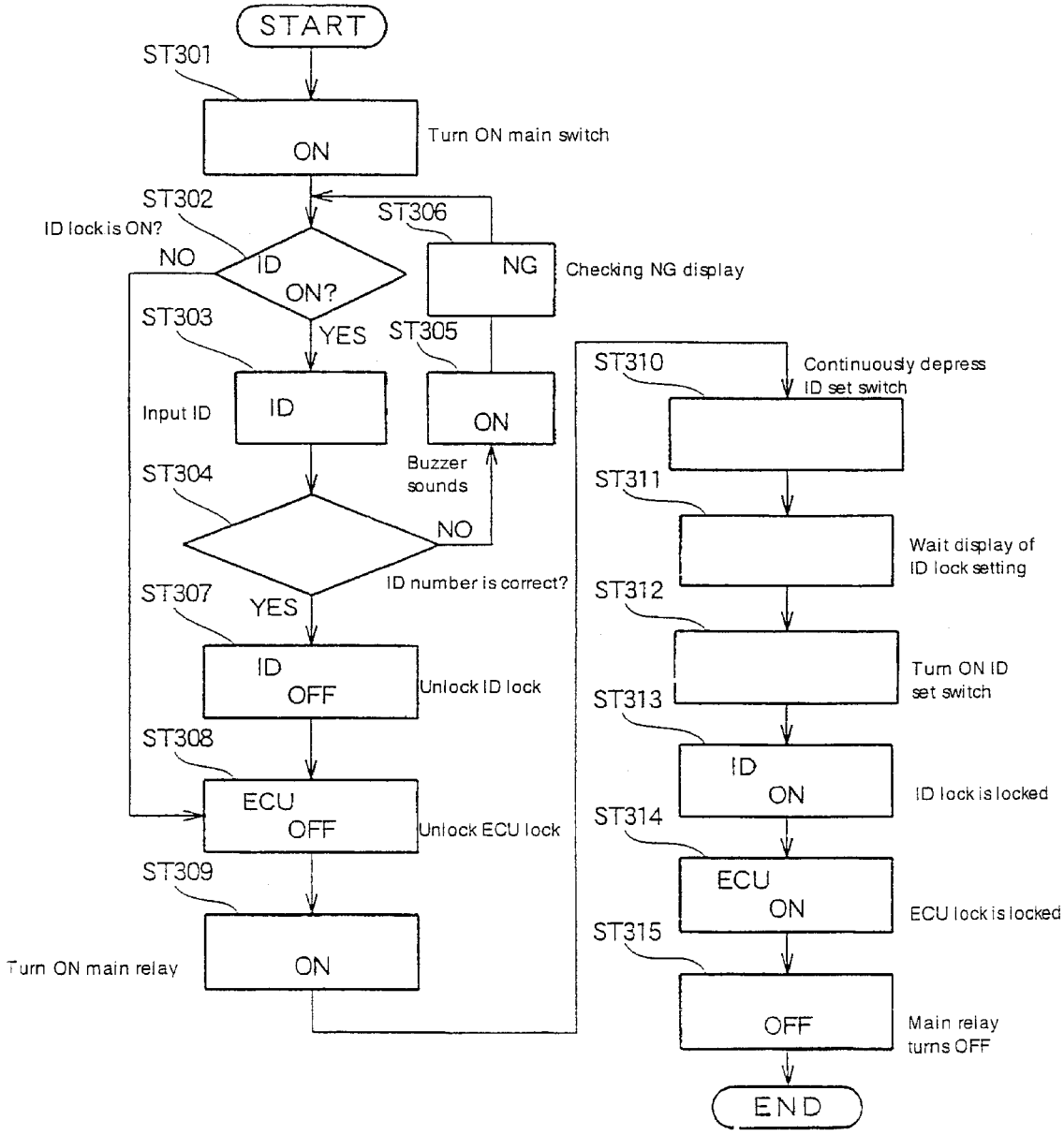
FIG. 13 is a flow chart for showing a procedure of locking/unlocking of theft prevention function for a small boat onto which a power source system according to the present invention has been mounted.

FIG. 13 is a flow chart showing a locking/unlocking procedure for a theft prevention function for a small boat onto which a power source system according to the present invention has been mounted (for reference numerals, refer to FIG. 7). In this respect, STxxx designates a step number.

ST301: Turn ON the main switch 45.

ST302: Judge whether or not the ID lock (theft prevention function) has turned ON. If YES, the sequence proceeds to ST303, and if NO, the sequence proceeds to ST307.

ST303: Input the ID number through the use of the ID number switch 3*d*. An allowable number of times for input of this ID number is set to a maximum of three times. That is, if a mistake is made three times, the power source for the display device 70 (Sec FIG. 4) will drop.

ST304: Judge whether or not the ID number is correct. If YES, the sequence proceed to ST306, and if NO, the sequence returns to ST302 through ST305 and ST306.

ST305: Sound a buzzer as a warning.

ST306: As a result of checking, display that the ID number is wrong (checking NG display). In other words, the ID mark 78*h* (See FIG. 5), the key mark 78*i* and the inputted number blink and display.

ST307: Unlock the ID lock.

ST308: Unlock the control unit (ECU) 101.

ST309: Turn ON the main relay 91. In this state, complete the start-up of the display device 70 (See FIG. 4). Hereinafter, an ID lock locking procedure will be shown.

ST310: Continuously depress the ID set switch 73*c*. In this case, a time period for continuously depressing is set to two or more seconds.

ST311: A setting wait display for the ID lock is displayed on the display device 70.

ST312: Press the ID set switch 73*c*.

ST313: The ID lock is locked.

ST314: The control unit (ECU) 101 is locked, and the display device 70 (See FIG. 4) becomes inoperable.

ST315: The main relay 91 turns OFF.

Figure 14A:
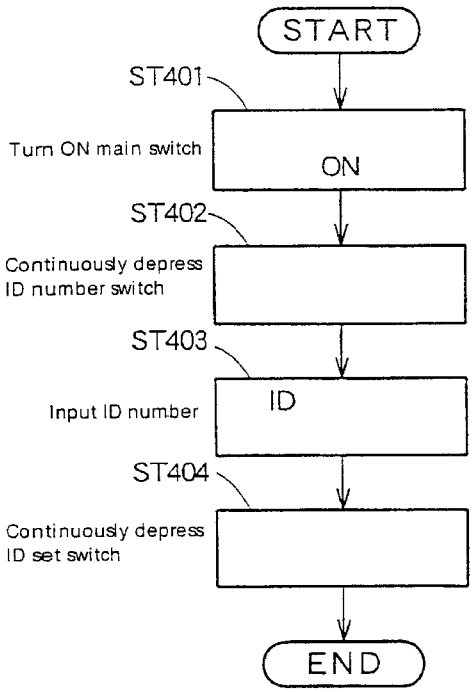
FIGS. 14(*a*) and (*b*) are flows chart for showing procedures of new ID registration/ID forced release of theft prevention function for a small boat onto which a power source system according to the present invention has been mounted.
Figure 14B:
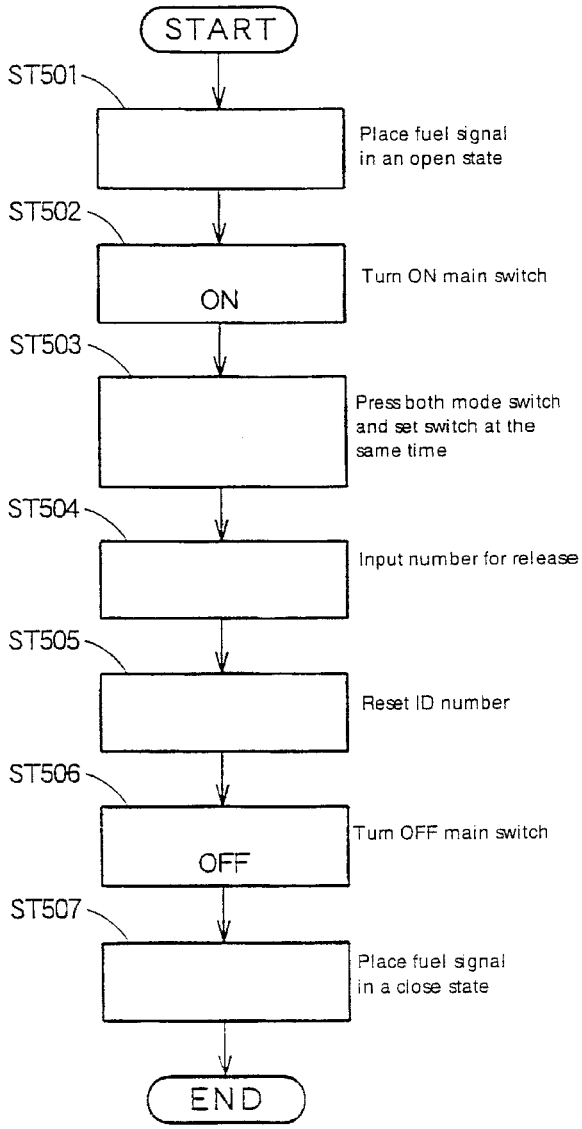

FIGS. 14(*a*) and 14(*b*) are flow charts (for reference numerals, refer to FIG. 5) showing procedures for new ID registration/ID forced release of the theft prevention function for a small boat onto which a power source system according to the present invention has been mounted. In this respect, STxxx designates a step number.

FIG. 14(*a*) shows a procedure for new ID registration of the ID lock (theft prevention function).

ST401: Turn ON the main switch 45 (See FIG. 7).

ST402: Continuously depress the ID number switch 73*d*. In this case, the time period for continuously depressing is set to two or more seconds.

ST403: Input the ID number through the use of the ID number switch 73*d*.

ST404: By continuously depressing the ID set switch 73*c*, a new ID number can be registered. In this case, the time period for continuously depressing is set to two or more seconds.

Thereafter, this operation will be completed by way of the steps of ST309 to ST312 shown in FIG. 13.

FIG. 14(*b*) shows the procedure for ID forced release of the ID lock (theft prevention function).

ST501: A fuel signal is caused to be in an open state. That is, it is caused to be in a state in which the harness from a fuel sensor (not shown) of the fuel injection system 61 has been removed. For example, one of the harnesses 87*a*, 87*b* shown in FIG. 6 is removed.

ST502: Turn ON the main switch 45 (See FIG. 7).

ST503: Continuously depress both the set switch 73*a* and the mode switch 73*b* at the same time. In this case, the time period for continuously depressing is set to five seconds.

ST504: Input a number for release as a predetermined number through the use of the ID number switch 73*d*. In this case, the number for release is a predetermined number during manufacture of the boat hull, such is the boat hull number.

ST505: The ID number is reset. In this respect, when the ID number is reset to become the initial value "000", the ID lock cannot be locked any longer, and the ID number must be inputted again.

ST506: Turn OFF the main switch 45.

ST507: The fuel signal is caused to be in a close state. In other words, the harness removed will be returned to the original state.

That is, by the operations in ST501 to ST505, the ID number can be forcibly released to reset the ID number.

When using the system again, the operator should start with new registration of the ID number again.

With this theft prevention system which is capable of turning ON the power source by the occupant inputting a secret number, a secret number release method for the theft prevention function may be a method by which the secret number is rendered capable of being released by removing at least one of a plurality of harnesses 87*a*, 87*b* (See FIG. 6) connected to the theft prevention function, and in this state, by inputting a predetermined number (number for release).

For example, in the unexpected situation where the operator or the owner has forgotten the secret number, the cost of replacing the entire theft prevention function could be very high. On the other hand, when the secret number can be simply reset, the theft prevention function cannot be maintained.

Thus, since the secret number is rendered capable of being released by removing at least one of a plurality of harnesses 87*a*, 87*b* (See FIG. 6) connected to the theft prevention function, and in this state, by inputting a predetermined number, the operator has a method of recovering his lost or forgotten secret number without seriously compromising the integrity of the theft prevention function.

Figure 15:
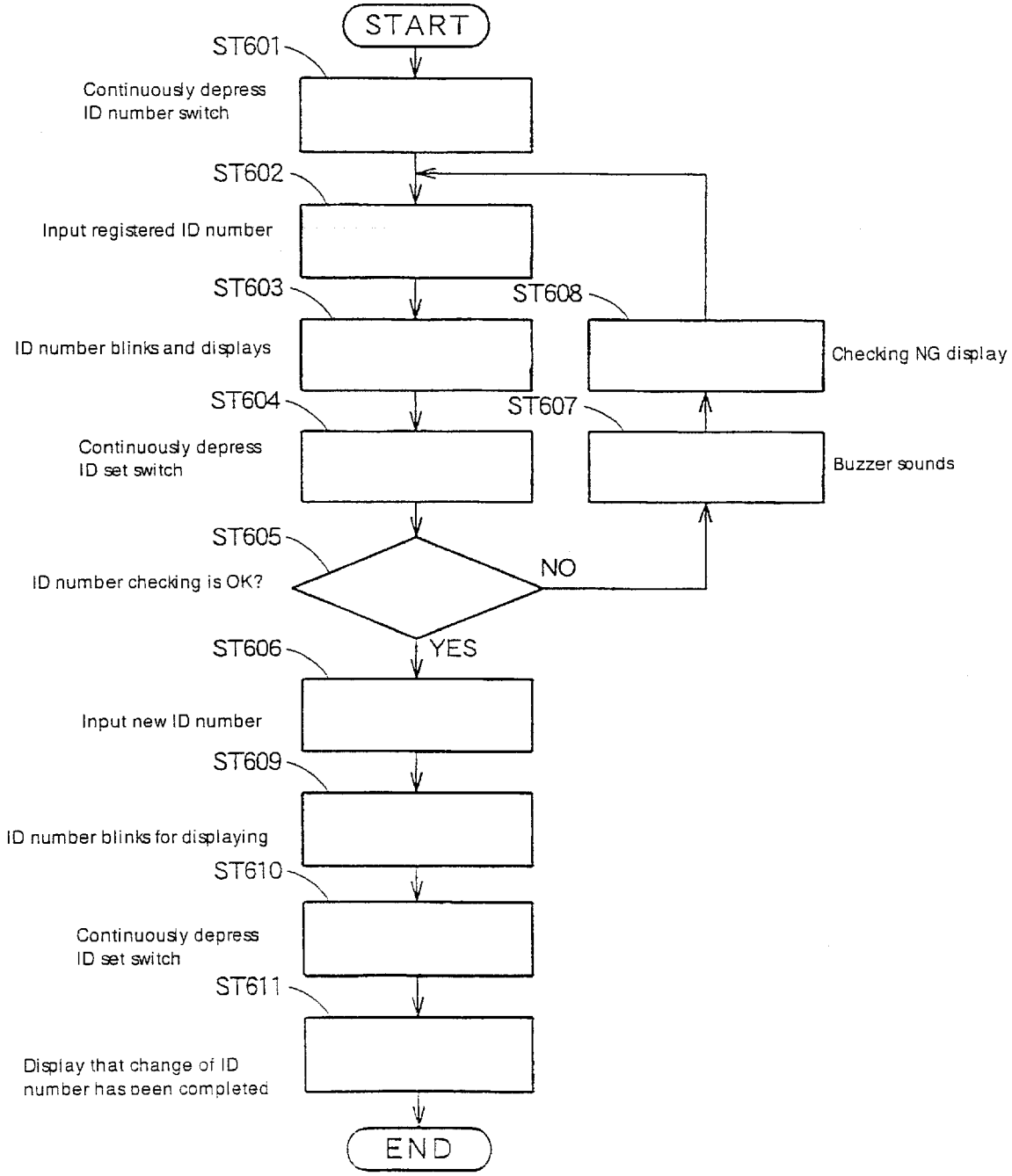
FIG. 15 is a flow chart for showing a procedure of changing the registered ID number of theft prevention function for a small boat onto which a power source system according to the present invention has been mounted.

FIG. 15 is a flow chart (for reference numerals, refer to FIG. 5) showing a procedure for changing a registration ID number of the theft prevention function for a small boat onto which a power source system according to the present invention has been mounted. In this respect, STxxx designates a step number.

ST601: Continuously depress the ID number switch 73*d*. In this case, a time period for continuously depressing is set to two or more seconds.

ST602: Input the registered ID number.

ST603: The inputted ID number blinks.

ST604: Continuously depress the number switch 73*d*. In this case, a time period for continuously depressing is set to two or more seconds.

ST605: Judge whether or not the ID number is correct. If YES, the sequence proceeds to ST506, and if NO, the sequence returns to ST602 through ST608. In this respect, an allowable number of times for input of this ID number has been set to three times at maximum. That is, if a mistake is made three times, the power source for the display device 70 (See FIG. 4) will drop.

ST606: Input the new ID number.

ST607: Sound the buzzer as a warning.

ST608: As a result of checking, display that the ID number is wrong (checking NG display). In other words, blink and display the ID mark 78*h* (See FIG. 5), the key mark 78*i* and the inputted number.

ST609: Blink the new ID number.

ST610: Continuously depress the ID set switch 73*c*. In this case, the time period for continuously depressing is set to two or more seconds.

ST611: By lighting the new ID number, display that the registration has been completed.

Figure 16:
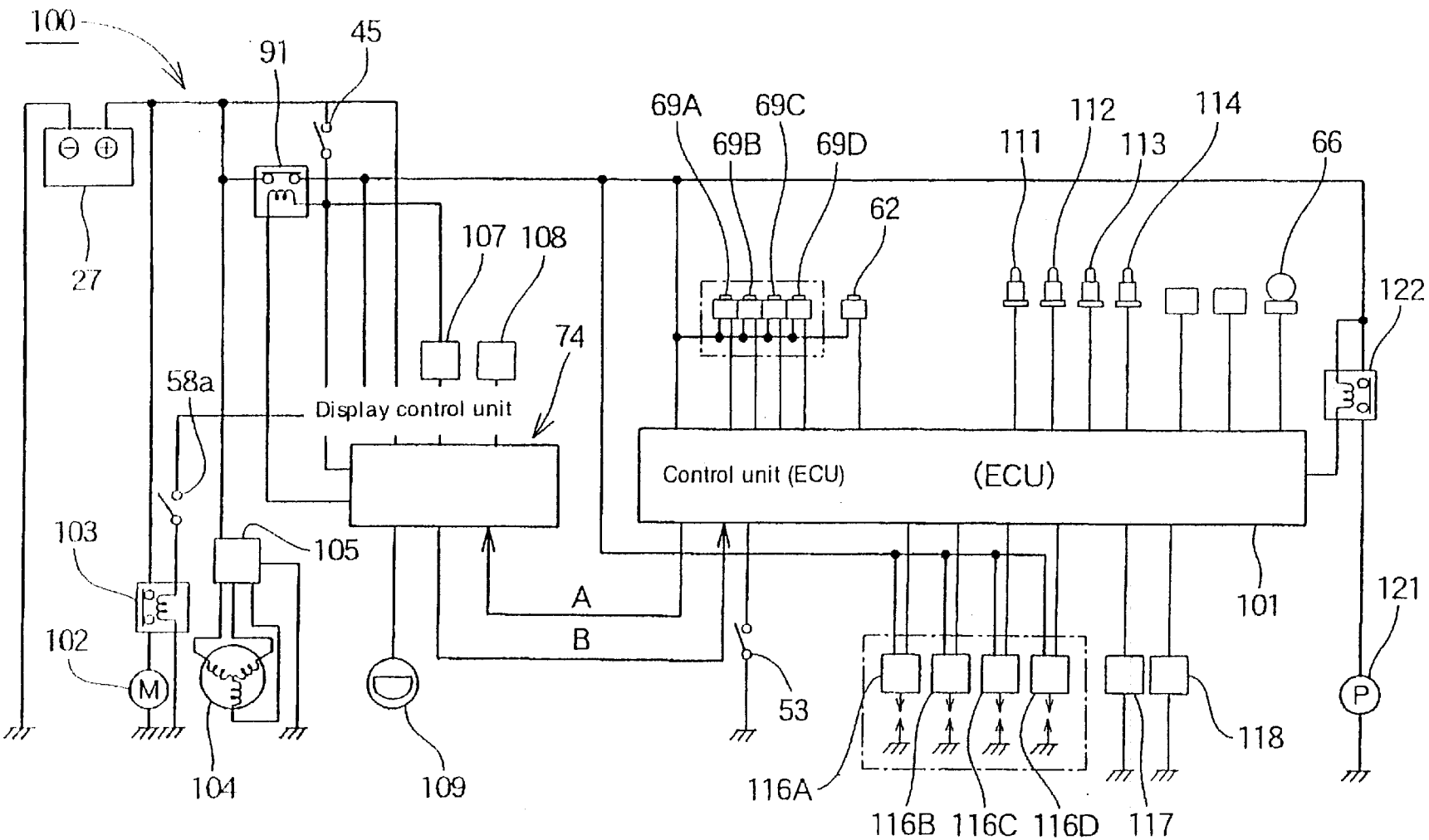
FIG. 16 is a view showing a control system of a small boat onto which a source system according to the present invention has been mounted.

FIG. 16 is a view showing a control system for a small boat onto which a power source system according to the present invention has been mounted.

The control system 100 for small boat includes a battery 27 which is a power source supply source; an injector 69 (displayed as "injector 69A to 69D" here) for the fuel injection system 61 (See FIG. 4), a main relay 91, a display control unit 74 mounted onto the display device 70 (See FIG. 5), and a control unit (ECU) 101 for controlling the engine 15 (See FIG. 1).

FIG. 16 also shows a starter 102, a starter relay 103 for turning ON/OFF the starter 102, a generator 104, a regulator 105 for regulating voltage generated by the generator, a buzzer 107 connected to the display control unit 74, a speed sensor 108 connected to the display control unit 74, a fuel sensor 109 connected to the display control unit 74, a temperature sensor 111 connected to the control unit (ECU) 101, and a water temperature sensor 112 connected to the control unit (ECU) 101. Also shown are an exhaust temperature detection sensor 113 connected to the control unit (ECU) 101, an oil temperature sensor 114 connected to the control unit (ECU) 101 for detecting temperature of the engine oil, ignition system members 116A to 116D (ignition plug and ignition coil), an oil pressure sensor 117, a knock sensor 118 for detecting knocking in the engine 15, a fuel pump 121, a relay 122 for turning ON/OFF the fuel pump.

A flow indicated by an arrow A shows engine oil information, temperature information, fuel information, engine number of evolutions information, warning lamp information and OTS (Off Throttle Steering System) information that are sent from the control unit (ECU) 101 to the display control unit 74.

Also, a flow indicated by an arrow B shows lock information and limited operation information that are sent from the display control unit 74 to the control unit (ECU) 10.

Figure 17:
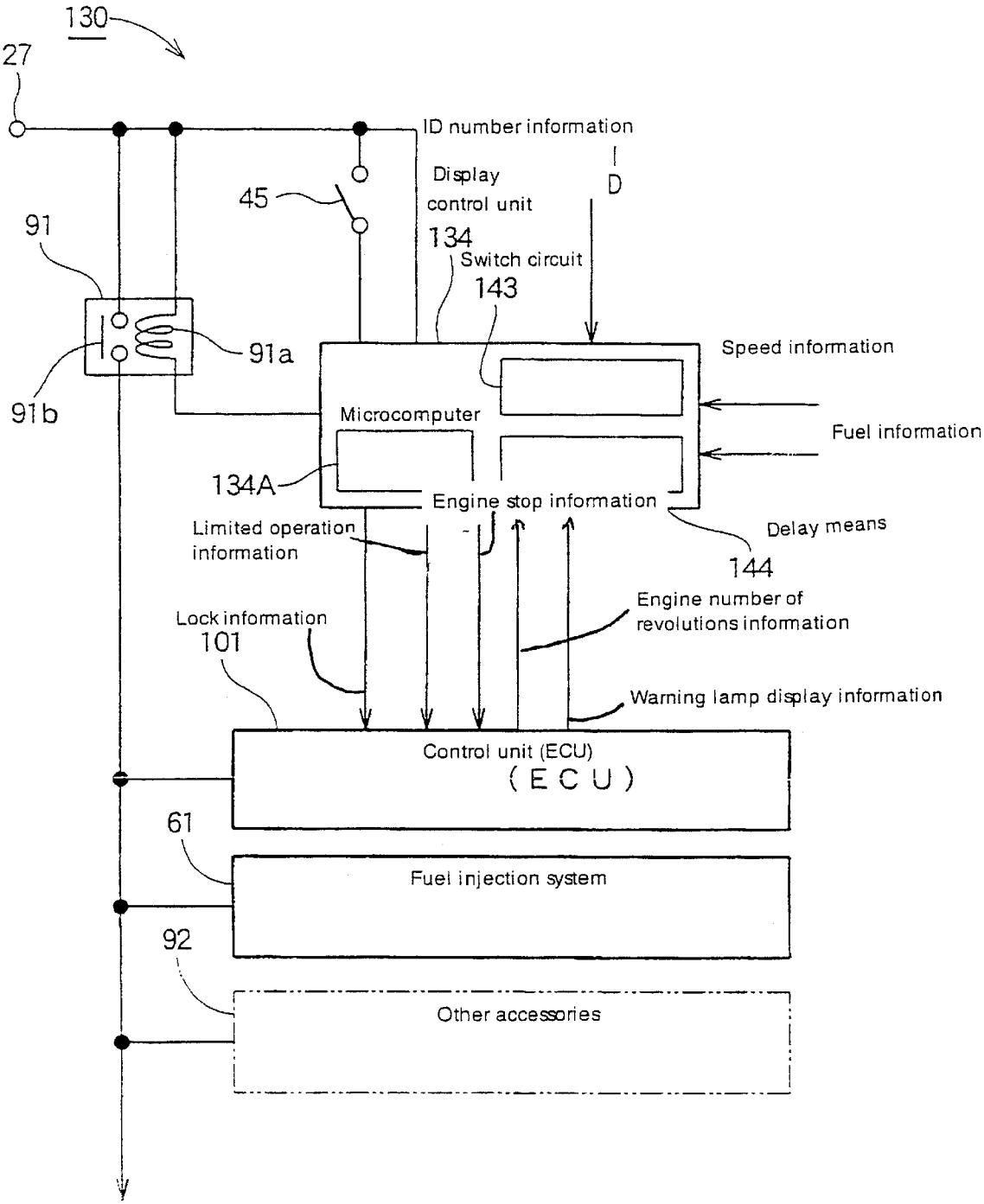
FIG. 17 is a block diagram showing a power source system for a small boat according to another embodiment of the present invention.

FIG. 17 is a block diagram showing a power source system for a small boat according to a second embodiment of the present invention. Components identical to those in the power source system 90 (See FIG. 7) are designated by the identical reference numerals, thus a detailed description will be omitted.

The power source system 130 includes a display control unit 134 as the control unit (display control unit 74), a main switch 45 with a lanyard switch connected between the display control unit 134 and a battery 27, a main relay 91 having a switch unit 91*b* for turning ON/OFF the power source of the battery 27 by exciting a coil portion 91*a* by the display control unit 134, and the control unit (ECU) 101 which turns ON/OFF through the use of the switch unit 91*b* of the main relay 91, and which controls the engine 15 (See FIG. 1) by giving and receiving information between the control unit (ECU) 101 and the display control unit 134. Also included is the fuel injection system 61 and other accessories 92 which are turned ON/OFF through the use of the switch unit 91*b* of the main relay 91.

The display control unit 134 shows a control unit (ECU) according to the second embodiment of the display control unit 74 mounted onto the display device 70 shown in FIG. 5. More specifically, the display control unit 134 has a microcomputer 134A which forms the heart, a switching circuit 133 for turning ON/OFF the power source of the display control unit 134 itself by inputting information of the main switch 45 with a lanyard switch and a predetermined ID number, and delay means 144 for delaying the operation of this switching circuit 143 by a predetermined time period. The display control unit 134 inputs ID information for theft prevention, information of the state of the main switch 45 with a lanyard switch and speed of the boat hull, fuel information for displaying the remaining quantity of fuel, information of number of revolutions of the engine; warning lamp display information for lighting a multifunctional display unit 78 shown in FIG. 5 and the warning lamp 72 to output limited operation information when a limited operation is performed by controlling the fuel injection system 61, locking information which turns OFF the main relay 91, and engine stop information. The display control unit 134 is a control unit (ECU) which enters a fault inspection mode when the display device 70 is turned ON.

Figure 18A:
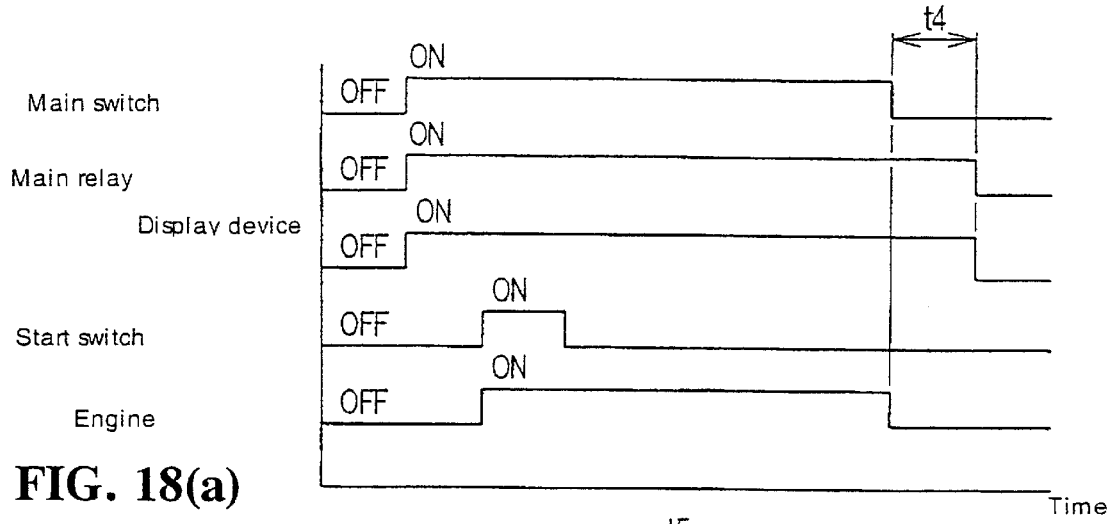
FIGS. 18(*a*)–(*c*) are explanatory views of the operation of the power source system for the small boat according to another embodiment of the present invention.
Figure 18B:
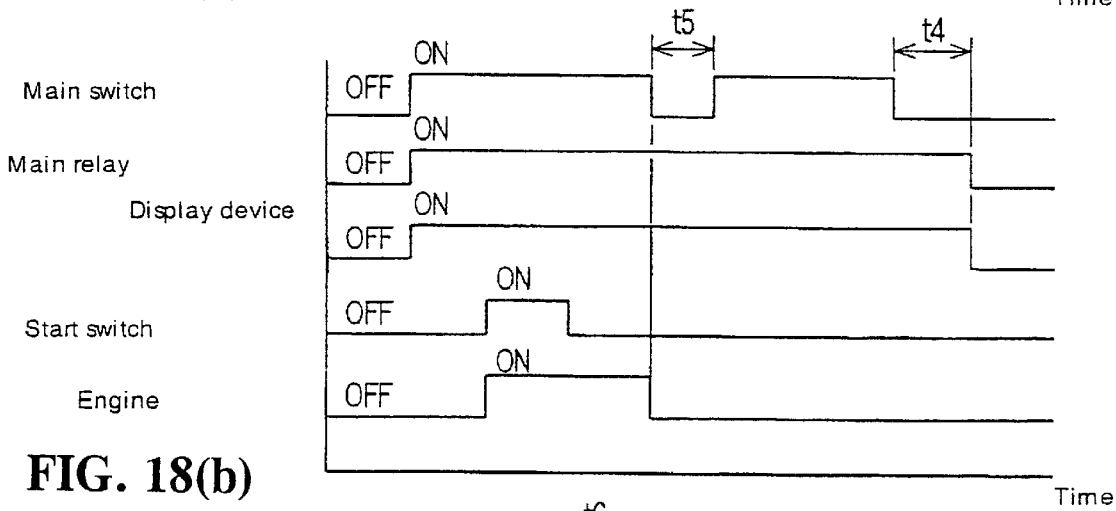
Figure 18C:
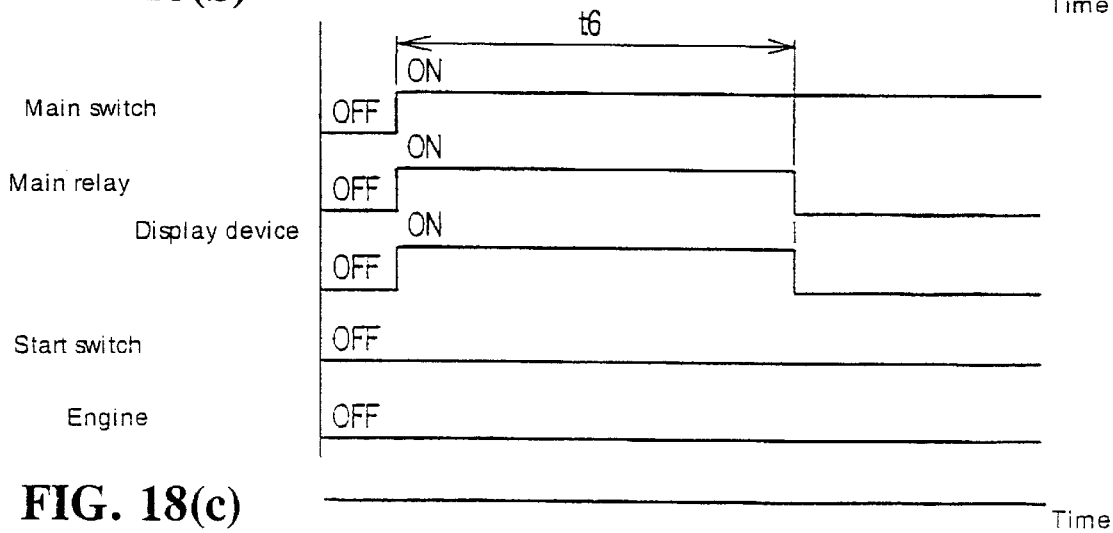

FIGS. 18(*a*) to 18(*c*) are operation explanatory views for a power source system for a small boat according to this second embodiment of the present invention, showing relationship in an operating state between the main relay, the display device, a starting switch and the engine (for symbols, refer to FIG. 17).

FIG. 18(*a*) shows the operation relationship when the lanyard switch portion 57 (See FIG. 8) has been pulled out, that is, at the time of completion of navigation or of drainage of ponded water.

First, as described in FIGS. 9(*a*) to 9(*c*), the lanyard switch portion 57 is caused to be fitted to the main switch body portion 58, whereby the main switch 45, the main relay 91 (See FIG. 7) and the display device 70 turn ON in synchronism. Pressing the starting switch 58*c* (See FIG. 4) starts the engine 15 (See FIG. 1).

Next, when the lanyard switch 57 is pulled out of the main switch body portion 58, the main switch 45 and the engine 15 turn OFF in synchronism. After a lapse of a predetermined time period t4, the main relay 91 and the display device 70 turn OFF (controlled by the delay means 144 provided for the display control unit 134 as shown in FIG. 17).

The power source system 130 according to the second embodiment may be the display control unit (control unit) 134 is an component part of a display device 70 (See FIG. 17) for displaying operation information of the small boat or boat hull information. After a lapse of a predetermined time period t4, since the main switch 45 shifts from the ON-state to the OFF-state, both the display control unit 134 and the main relay 91 are simultaneously switched from the ON-state to the OFF-state.

When the display control unit 134 is an component part of the display device 70 for displaying operation information of the small boat or the boat hull information, both the display control unit 134 and the main relay 91 are switched from the ON-state to the OFF-state at the same thee, whereby the state of the main relay 91 can be grasped by the display function of the display device 70. As a result, convenience for the operator is improved.

FIG. 18(*b*) shows operation relationship when the engine 15 is stopped without pulling the lanyard switch portion 57, that is, when the stop button 58*e* is pressed to turn OFF the main switch 45 in the ease of taking a seat for standby or the like and the main switch 45 is turned ON within time period t5 (t5<t4). Since the design is such that during time period t4 since the main switch 45 is turned OFF as shown in FIG. 18(*a*), the main relay 91 and the display device 70 is capable of maintaining the ON-state, only the engine 15 is stopped in the above-described operation to standby while the main relay 91 and the display device 70 remain in the ON-state. Accordingly, pressing the starting switch 58*e* enables the small boat to be navigated immediately.

Also, with the power source system 130 according to the second embodiment, when the main switch 45 shifts from the ON-state to the OFF-state, the display control unit 134 instantaneously outputs a stop signal to the control limit (ECU) 101 (See FIG. 17), and the engine 15 (See FIG. 1) is stopped on the basis of this stop signal through the use of the control unit (ECU) 101. Also, when the OFF-state of the main switch 45 is within a predetermined time period t5, the display control unit 134 maintains the ON-state of the main relay 91.

Generally, when the main relay is turned OFF, the control unit (ECU) for controlling the engine is also often turned OFF. When starting up the power source, the control unit (ECU) 101 may subject the display device and the accessories to fault diagnosis in the same manner as the display control unit (control unit) 134, and when the power source for the control unit (ECU) 101 is turned OFF, it may take time for the small boat 10 (see FIG. 1) to shift to a navigable state.

More specifically, even when the engine 15 is stopped temporarily, if the OFF-state of the main switch 45 is within a predetermined time period t4, the ON-state of the main relay 91 is maintained. Thus, it is possible to shift from the temporarily stopped state to a navigable state in a short time.

FIG. 18(*c*) shows operation relationship when the lanyard switch portion 57 (See FIG. 8) is not pulled out, but is left standing.

When a predetermined time period t6 has elapsed with the engine 15 turned OFF, and the main switch 45, the main relay 91 and the display device 70 (See FIG. 4) turned ON, the main relay 91 and the display device 70 are caused to be automatically turned OFF (controlled by the switching circuit 143 provided for the display control unit 74 shown in FIG. 17) through the use of the display control unit 134 in order to minimize power comsumption of the battery 27 (See FIG. 1).

In this respect, in the second embodiment, the fuel injection system 61 and other accessories 92 are rendered capable of being controlled as shown in FIG. 10, but the present invention is not limited thereto. Alternatively, any structure may be taken, as long as the ON/OFF of the power source to be supplied to the accessories and the like can be collectively controlled.

The present invention exhibits the following effects due to the above-described structure.

According to the first aspect of the invention, a main relay is provided for turning ON/OFF the power source to be supplied to the accessories and a control unit (display control unit) connected to the main switch in parallel in order to control this main relay. The design is such that an ON/OFF state of the main switch is monitored through the use of the control unit (display control unit) and the main relay is ON/OFF controlled on the basis of the ON/OFF state. Therefore, it is possible to collectively control the ON/OFF of the power source to be supplied to the accessories including the fuel injection system. As a result, the power source system can be simplified.

For example, when starting Up the power source, in the control unit (display control unit), the accessories are often subjected to fault diagnosis and the like. Therefore, when the power source of the control unit (display control unit) is carelessly dropped, it takes time to start up the control unit (display control unit).

According to the second aspect of the present invention, the design is such that when the main switch shifts from an ON-state to an OFF-state, the main relay is instantaneously switched from ON to OFF, and the control unit (display control unit) maintains the ON-state in the OFF-state of the main switch during a predetermined time period. Therefore, the supply of the power source to the accessories and the like including the fuel injection system is stopped to temporarily stop the small boat. Since in this temporarily stopped state, the control unit (display control unit) can maintain the started-up state, the small boat can shift from the temporarily stopped state to a navigable state in a short time. As a result, the convenience of the small boat can be improved.

According to the third aspect of the present invention, since when information for turning OFF the main relay is outputted from the control unit (display control unit), the control unit causes a stop signal for stopping the engine to be outputted on the basis of this OFF information, even when, for example, the main relay has directly been coupled, there is no possibility that the engine starts. Therefore, the small boat can be prevented from being stolen.

When, for example, the main relay is turned OFF, the control unit (ECU) for controlling, the engine is also often turned OFF. When starting up the power source, the control unit (ECU) may subject the display device and the accessories to fault diagnosis in the same manner as the control unit (display control unit). Therefore, when the power source for the control unit (ECU) is turned OFF, it may take time to shift the small boat to a navigable state.

According to a fourth aspect of the present invention, when the main switch shifts from the ON-state to the OFF-state, the control unit (display control unit) instantaneously outputs a stop signal to the control unit (ECU), and the engine is stopped by the control unit (ECU) on the basis of this stop signal. Further, when the OFF-state of the main switch is within a predetermined time period, the control unit (display control unit) the ON-state of the main relay is maintained. Therefore, even when the engine is stopped to temporarily stop the small boat, the ON-state of the main relay is maintained if the OFF-state of the main switch is within a predetermined time period. Thus, it is possible to shift from the temporarily stopped state to a navigable state in a short time.

According to a fifth aspect of the present invention, the design is such that when the control unit (display control unit) is a component part of a display device for displaying operation information of the small boat or boat hull information, both the control unit (display control unit) and the main relay are switched from the ON-state to the OFF-state at the same time. Thus, the state of the main relay can be grasped by the display function of the control unit (display control unit). As a result, convenience for the operator can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A power source system for supplying a power source to accessories and an engine of a boat, said power source system comprising:

an electronic control unit (ECU) which controls said accessories and said engine;

a main switch with a lanyard switch capable of turning OFF said power source in case of an emergency by connecting to an occupant by a wire of the lanyard;

a main relay for turning ON/OFF the power source to be supplied to said accessories and said electronic control unit (ECU); and a display control unit connected in parallel to said main switch in order to control said main relay, wherein an ON/OFF state of said main switch is monitored by said display control unit to control an ON/OFF state of said main relay on the basis of the ON/OFF state of said main switch, and wherein information is outputted from said display control unit to said electronic control unit (ECU) for controlling said accessories.

2. The power source system for a boat according to claim 1, wherein shifting of said main switch from the ON-state to the OFF-state causes said main relay to switch from ON to OFF instantaneously, and also causes said display control unit to be maintained in an ON-state while said main switch is in the OFF-state for a predetermined period of time.

3. The power source system for a boat according to claim 1, wherein said display control unit has a theft prevention function, and when information for turning OFF said main relay is outputted from said display control unit, a stop signal for stopping said engine is outputted to said electronic control unit (ECU) for controlling said engine on the basis of said information for turning OFF.

4. The power source system for a boat according to claim 1, wherein shifting said main switch shifts from the ON-state to the OFF-state causes said display control unit to output a stop signal to said electronic control unit (ECU) instantaneously, thus causing said engine to be stopped by said electronic control unit (ECU) on the basis of said stop signal, and while the main switch is maintained in the OFF-state for a predetermined period of time, said display control unit maintains the ON-state of said main relay.

5. The power source system for a boat according to claim 4, wherein said display control unit is a component part of a display device for displaying operational information of the boat or boat hull information, and wherein after a lapse of a predetermined time period, shifting said main switch shifts from the ON-state to the OFF-state causes both said display control unit and said main relay to switch from the ON-state to the OFF-state simultaneously.

6. The power source system for a boat according to claim 1, wherein the display control unit includes a microcomputer, a switching circuit, and delay means for delaying operation of said switching circuit.

7. The power source system for a boat according to claim 1, wherein the main switch with the lanyard includes a clip portion for turning ON/OFF the power source by sandwiching it in or removing it from a main switch body portion, and a hand strap to be worn on a arm of the occupant, said wire of the lanyard extending from the clip.

8. A power source system for a boat for supplying a power source to a boat, said power source system comprising:

an electronic control unit (ECU) for controlling accessories and an engine;

a main switch with a lanyard switch capable of turning OFF said power source in case of an emergency by connecting to an occupant by a wire of the lanyard;

a main relay for turning ON/OFF power source to be supplied to said accessories; and display control unit connected in parallel to said main switch in order to control said main relay, wherein an ON/OFF state of said main switch is monitored by said display control unit to control an ON/OFF state of the main relay on the basis of said ON/OFF state of the main switch, and wherein the display control unit also drives a display device for displaying operational status of the engine and the accessories.

9. The power source system for a boat according to claim 8, wherein shifting of said main switch from the ON-state to the OFF-state causes said main relay to switch from ON to OFF instantaneously, and also causes said display control unit to be maintained in an ON-state while said main switch is in the OFF-state for a predetermined period of time.

10. The power source system for a boat according to claim 8, wherein said display control unit has a theft prevention function, and when information for turning OFF said main relay is outputted from said display control unit, a stop signal for stopping said engine is outputted to said control unit (ECU) for controlling said engine on the basis of said information for turning OFF.

11. The power source system for a boat according to claim 8, wherein shifting said main switch shifts from the ON-state to the OFF-state causes said display control unit to output a stop signal to said control unit (ECU) instantaneously, thus causing said engine to be stopped by said control unit (ECU) on the basis of said stop signal, and while the main switch is maintained in the OFF-state for a predetermined period of time, said display control unit maintains the ON-state of said main relay.

12. The power source system for a boat according to claim 11, wherein said display control unit is a component part of a display device for displaying operational information of the boat or boat hull information, and wherein after a lapse of a predetermined time period, shifting said main switch shifts from the ON-state to the OFF-state causes both said display control unit and said main relay to switch from the ON-state to the OFF-state simultaneously.

13. The power source system for a boat according to claim 8, wherein the display control unit includes a microcomputer, a switching circuit, and delay means for delaying operation of said switching circuit.

14. The power source system for a boat according to claim 8, wherein the main switch with the lanyard includes a clip portion for turning ON/OFF the power source by sandwiching it in or removing it from a main switch body portion, and a hand strap to be worn on a arm of the occupant, said wire of the lanyard extending from the clip.

15. The power source system for a boat according to claim 8, wherein the display control unit is mounted onto said display device.

16. A power source system for a boat for supplying a power source to the boat, said power source system comprising:

an electronic control unit (ECU) for controlling accessories and an engine;

a main switch with a lanyard switch capable of turning OFF power source in case of an emergency by connecting to an occupant by a wire of the lanyard;

a main relay for turning ON/OFF power source to be supplied to said accessories; and a display control unit connected in parallel to said main switch in order to control said main relay, wherein an ON/OFF state of said main switch is monitored by said display control unit to control an ON/OFF state of the main relay on the basis of said ON/OFF state of the main switch, and wherein said display control unit has a theft prevention function, and when information for turning OFF said main relay is outputted from said display control unit, a stop signal for stopping said engine is outputted to said control unit (ECU) for controlling said engine on the basis of said information for turning OFF.

17. The power source system for a boat according to claim 16, wherein shifting of said main switch from the ON-state to the OFF-state causes said main relay to switch from ON to OFF instantaneously, and also causes said display control unit to be maintained in an ON-state while said main switch is in the OFF-state for a predetermined period of time.

18. The power source system for a boat according to claim 16, wherein shifting said main switch shifts from the ON-state to the OFF-state causes said display control unit to output a stop signal to said control unit (ECU) instantaneously, thus causing said engine to be stopped by said control unit (ECU) on the basis of said stop signal, and while the main switch is maintained in the OFF-state for a predetermined period of time, said display control unit maintains the ON-state of said main relay.

19. The power source system for a boat according to claim 18, wherein said display control unit is a component part of a display device for displaying operational information of the boat or boat hull information, and wherein after a lapse of a predetermined time period, shifting said main switch shifts from the ON-state to the OFF-state causes both said display control unit and said main relay to switch from the ON-state to the OFF-state simultaneously.

20. The power source system for a boat according to claim 16, wherein the display control unit includes a microcomputer, a switching circuit, and delay means for delaying operation of said switching circuit.

* * * * *